US011043780B2

(12) United States Patent
Wang

(10) Patent No.: US 11,043,780 B2
(45) **Date of Patent: *Jun. 22, 2021**

(54) DOUBLE DENSITY SMALL FORM-FACTOR PLUGABLE CONNECTOR

(71) Applicant: Molex, LLC, Lisle, IL (US)

(72) Inventor: Bing-Jyun Wang, Taipei (TW)

(73) Assignee: Molex, LLC, Lisle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/871,054

(22) Filed: May 11, 2020

(65) Prior Publication Data

US 2020/0274309 A1 Aug. 27, 2020

Related U.S. Application Data

(63) Continuation of application No. 16/038,326, filed on Jul. 18, 2018, now Pat. No. 10,651,618.

(30) Foreign Application Priority Data

Jul. 19, 2017 (CN) ..... 201710590364.3
Jun. 20, 2018 (CN) ..... 201820954967.7

(51) Int. Cl.
*H01R 13/64* (2006.01)
*H01R 13/645* (2006.01)
(Continued)

(52) U.S. Cl.
CPC ..... *H01R 43/005* (2013.01); *H01R 4/4827* (2013.01); *H01R 13/64* (2013.01);
(Continued)

(58) Field of Classification Search
CPC ..... H01R 12/71; H01R 12/72; H01R 12/721; H01R 13/00; H01R 13/64; H01R 13/6546;
(Continued)

(56) References Cited

U.S. PATENT DOCUMENTS 4,992,052 A 2/1991 Verhoeven
7,922,534 B2 * 4/2011 Lin ..... H01R 13/64 439/607.27

(Continued)

FOREIGN PATENT DOCUMENTS

TW 532734 5/2003

OTHER PUBLICATIONS

"SFP-DD Hardware Specification for SFP Double Density 2X Pluggable Transceiver", Rev 3.0 Apr. 10, 2019, pp. 1-60.

(Continued)

*Primary Examiner* — Vanessa Girardi

(57) ABSTRACT

The present disclosure discloses an electrical connection device and a plug assembly, the electrical connection device comprises a receptacle assembly and a plug assembly. The receptacle assembly comprises a cage and a connector. The plug assembly comprises an outer housing and a communication module provided in the outer housing. The outer housing has a main body which can be inserted into the cage along the mating direction to be mated with the connector. The receptacle assembly is provided with at least one guide groove extending along the mating direction, and the outer housing of the plug assembly is provided with at least one guide block protruding from the main body to correspond to the at least one guide groove, when the plug assembly is mated with the receptacle assembly, the at least one guide block enters into the corresponding guide groove along the mating direction.

12 Claims, 26 Drawing Sheets

(51) Int. Cl.

| | |
|---|---|
| ***H01R 13/6591*** | (2011.01) |
| ***H01R 43/26*** | (2006.01) |
| ***H01R 43/00*** | (2006.01) |
| ***H01R 43/20*** | (2006.01) |
| ***H01R 4/48*** | (2006.01) |
| *H01R 12/72* | (2011.01) |
| *H01R 13/6594* | (2011.01) |

(52) U.S. Cl.
CPC ..... *H01R 13/6456* (2013.01); *H01R 13/6591* (2013.01); *H01R 43/205* (2013.01); *H01R 43/26* (2013.01); *H01R 12/721* (2013.01); *H01R 13/6594* (2013.01)

(58) Field of Classification Search
CPC ... H01R 13/658; H01R 13/6591; H01R 43/26
See application file for complete search history.

(56) References Cited

U.S. PATENT DOCUMENTS

| | | | | |
|---|---|---|---|---|
| 8,727,795 | B2 | 5/2014 | Feyder et al. | |
| 9,431,764 | B2 | 8/2016 | Ho | |
| 9,893,468 | B2 * | 2/2018 | Zhao | H01R 24/60 |
| 10,651,618 | B2 | 5/2020 | Wang | |
| 2018/0366875 | A1 | 12/2018 | Shinder-Lerner et al. | |

OTHER PUBLICATIONS

Non-Final rejection received for U.S. Appl. No. 16/038,326, dated Jul. 2, 2019, 10 pages.

* cited by examiner

DOUBLE DENSITY SMALL FORM-FACTOR PLUGABLE CONNECTOR

RELATED APPLICATIONS

This application claims priority to U.S. application Ser. No. 16/038,326, filed Jul. 18, 2018, now U.S. Pat. No. 10,651,618, which in turn claims priority to Chinese Application No. 201710590364.3, filed Jul. 19, 2017, and Chinese Application No. 201820954967.7, filed Jun. 20, 2018, all of which are incorporated herein by reference in their entirety.

TECHNICAL FIELD

The present disclosure relates to an electrical connection device, especially relates to an electrical connection device and a plug assembly.

BACKGROUND ART

An existing SFP (Small Form-factor Pluggable) connector is a small form-factor pluggable interface for data communication and is widely used in switches over Ethernet to implement interconnection between switches and between switches and servers. The SFP connector can also connect optical fiber cables.

An SFP-DD (SFP Double Density) connector under development presently has the double density of SFP. The SFP-DD has more two rows (upper and lower rows) of contacts than the SFP, that is, a SFP-DD receptacle has more two rows of terminals than a SFP receptacle in a mating direction and forms a front two rows of contact portions which face in an up-down direction and a back two rows of contact portions which face in the up-down direction in the slot, and a SFP-DD plug has more one row of connection pads (actually, that is more one upper row of connection pads and one lower row of connection pads, because the one upper row of connection pads and the one lower row of connection pads face each other in the up-down direction, the one upper row of connection pads and the one lower row of connection pads are counted as one row of connection pads) than a SFP plug in the mating direction, thus the SFP-DD receptacle and the SFP-DD plug respectively have longer lengths than the SFP receptacle and the SFP plug in the mating direction. However, the SFP connector and the SFP-DD connector are similar in appearance, the SFP receptacle and SFP-DD receptacle have the same port sizes, when the SFP plug is inserted into the SFP-DD receptacle, because the number of the terminals of the SFP-DD receptacle is greater than the number of the connection pads of the SFP plug, the SFP-DD receptacle can also be compatible with the SFP plug. However, when the SFP-DD plug is inserted into the SFP receptacle, a half of the connection pads of the SFP-DD plug do not have corresponding terminals of the SFP receptacle to establish an electrical connection. In other words, the SFP receptacle cannot be compatible with the SFP-DD plug.

SUMMARY

Therefore, one object of the present disclosure is to provide an electrical connection device having a preventing improper insertion configuration to prevent a plug and a receptacle which are incompatible from being improperly inserted.

Therefore, another object of the present disclosure is to provide a plug assembly having a preventing improper insertion configuration to prevent the plug assembly from being improperly inserted into a receptacle which is incompatible with the plug assembly.

Accordingly, in some embodiments, an electrical connection device of the present disclosure comprises a receptacle assembly and a plug assembly. The receptacle assembly comprises a cage and a connector, the cage defines a port positioned at a front end and an accommodating space extending backwardly from the port along a mating direction, the connector is positioned in the accommodating space and has a slot, an entrance of the slot is aligned with the port and extends backwardly along the mating direction. The plug assembly comprises an outer housing and a communication module provided in the outer housing, the outer housing has a main body which can be inserted into the cage along the mating direction to be mated with the connector, the communication module has a circuit board positioned in the main body, and the circuit board has a mating end portion used to be inserted into the slot. The receptacle assembly is provided with at least one guide groove extending along the mating direction, and the outer housing of the plug assembly is provided with at least one guide block protruding from the main body to correspond to the at least one guide groove, when the plug assembly is mated with the receptacle assembly, the at least one guide block enters into the corresponding guide groove along the mating direction.

In some embodiments, the at least one guide groove is provided to the cage.

In some embodiments, the at least one guide groove is an open groove extending backwardly from the port along the mating direction on the cage.

In some embodiments, the cage has two guide grooves spaced apart from each other and a leaf spring positioned between the two guide grooves, the leaf spring has a lock opening, the outer housing has two guide blocks protruding from a bottom face of the main body and further has a lock block used to detachably latched to the lock opening.

In some embodiments, inner sides of the two guide grooves are respectively defined by two opposite sides of the leaf spring.

In some embodiments, the cage comprises a shell, the shell has a top wall, two side walls respectively connected to two sides of the top wall, a rear wall connecting the top wall and the two side walls and facing the port and a bottom wall connected to the two side walls and facing the top wall, the bottom wall, the top wall and the two side walls together define the port, and the two guide grooves are formed to the bottom wall.

In some embodiments, the cage further comprises a grounding frame, the grounding frame comprises an upper frame portion and a lower frame portion, the upper frame portion and the lower frame portion together surround a periphery of the shell adjacent to the port, and a portion of the lower frame portion overlapped with the bottom wall is formed with a guide portion used to guide the guide blocks.

In some embodiments, the cage comprises a shell, the shell has a top wall, two side walls respectively connected to two sides of the top wall, a rear wall connecting the top wall and the two side walls and facing the port and a bottom wall connected to the two side walls and facing the top wall, the bottom wall, the top wall and the two side walls together define the port, the main body of the plug assembly has a top face, the at least one guide block is a boss protruding from the top face, the at least one guide groove extends backwardly from the port along the mating direction and is defined by an avoiding portion, the avoiding portion is formed to the top wall and defines the guide groove extending backwardly from the port along the mating direction to accommodate the guide block correspondingly.

In some embodiments, the at least one guide groove is provided to the connector.

In some embodiments, the connector further has an insulating body, the insulating body defines the slot and has two outer side faces respectively on left and right sides, at least one of the two outer side faces is provided with the at least one guide groove recessed inwardly, the main body of the plug assembly has two inner side faces facing each other, and at least one of the two inner side faces is provided with the at least one guide block protruding therefrom.

In some embodiments, the mating end portion of the circuit board is provided with totally four rows of conductive pads which are respectively arranged in front two rows and back two rows in the mating direction on opposite two board surfaces of the mating end portion, the connector further has a plurality of terminals arranged in four rows and each terminal has an elastic contact portion extending into the slot, the elastic contact portions of the plurality of terminals are arranged in front two rows and back two rows in the mating direction in the slot and the front two rows face each other in the up-down direction and the back two rows face each other in the up-down direction, so that the plurality of elastic contact portions respectively contact the plurality of conductive pads to form an electrical connection when the mating end portion is inserted into the slot.

In some embodiments, the receptacle assembly and the plug assembly conform to a SFP-DD specification.

Accordingly, in some embodiments, a plug assembly of the present disclosure is adapted to be mated with a receptacle assembly, the receptacle assembly comprises a cage and a connector positioned in the cage, the cage defines a port positioned at a front end and an accommodating space extending backwardly from the port along a mating direction, the receptacle assembly is provided with at least one guide groove extending along the mating direction, the plug assembly comprises an outer housing and a communication module. The outer housing has a main body which can be inserted into the cage along the mating direction to be mated with the connector and at least one guide block protruding from the main body to correspond to the at least one guide groove, when the plug assembly is mated with the receptacle assembly, the at least one guide block enters into the corresponding guide groove along the mating direction. The communication module is provided in the outer housing and has a circuit board positioned in the main body, and the circuit board has a mating end portion.

In some embodiments, the mating end portion of the circuit board is provided with totally four rows of conductive pads which are respectively arranged in front two rows and back two rows in the mating direction on opposite two board surfaces of the mating end portion.

In some embodiments, the plug assembly conforms to a SFP-DD specification.

The present disclosure has the following efforts: the plug assembly can only be mated with the receptacle assembly provided with the corresponding guide groove by means of the guide block, which can prevent the plug assembly from being improperly inserted into the receptacle assembly generally having no corresponding guide groove, so as to achieve the function of preventing improper insertion.

BRIEF DESCRIPTION OF THE DRAWINGS

Other characteristics and effects of the present disclosure will be apparent through detailed description of embodiments with referring to the Figures, and in which.

DETAILED DESCRIPTION OF THE PREFERRED EMBODIMENTS

Figure 1:
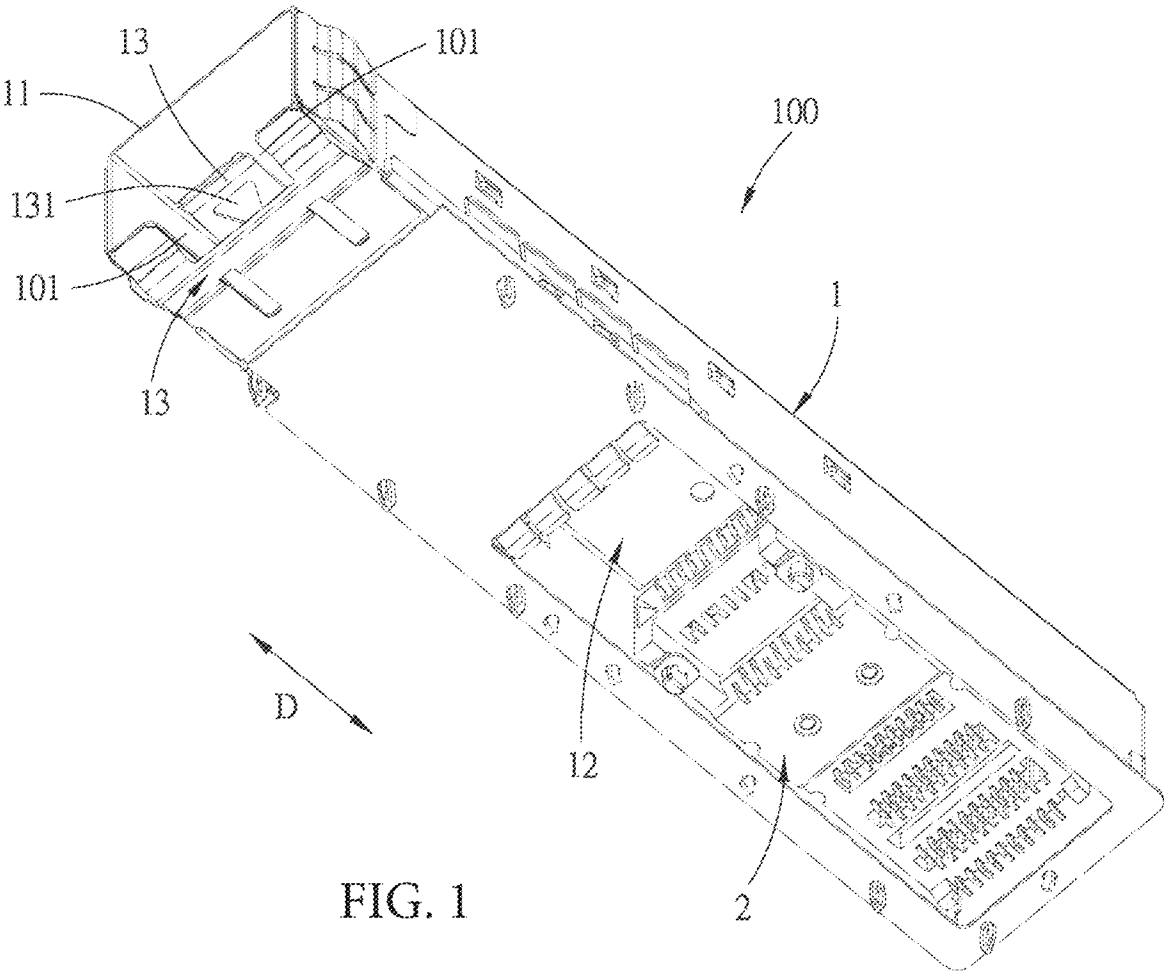
FIG. 1 is a perspective view of a receptacle assembly of a first embodiment of an electrical connection device of the present disclosure.

Before the present disclosure is described in detail, it should be noted that the similar element is identified by the same reference numeral.

Figure 2:
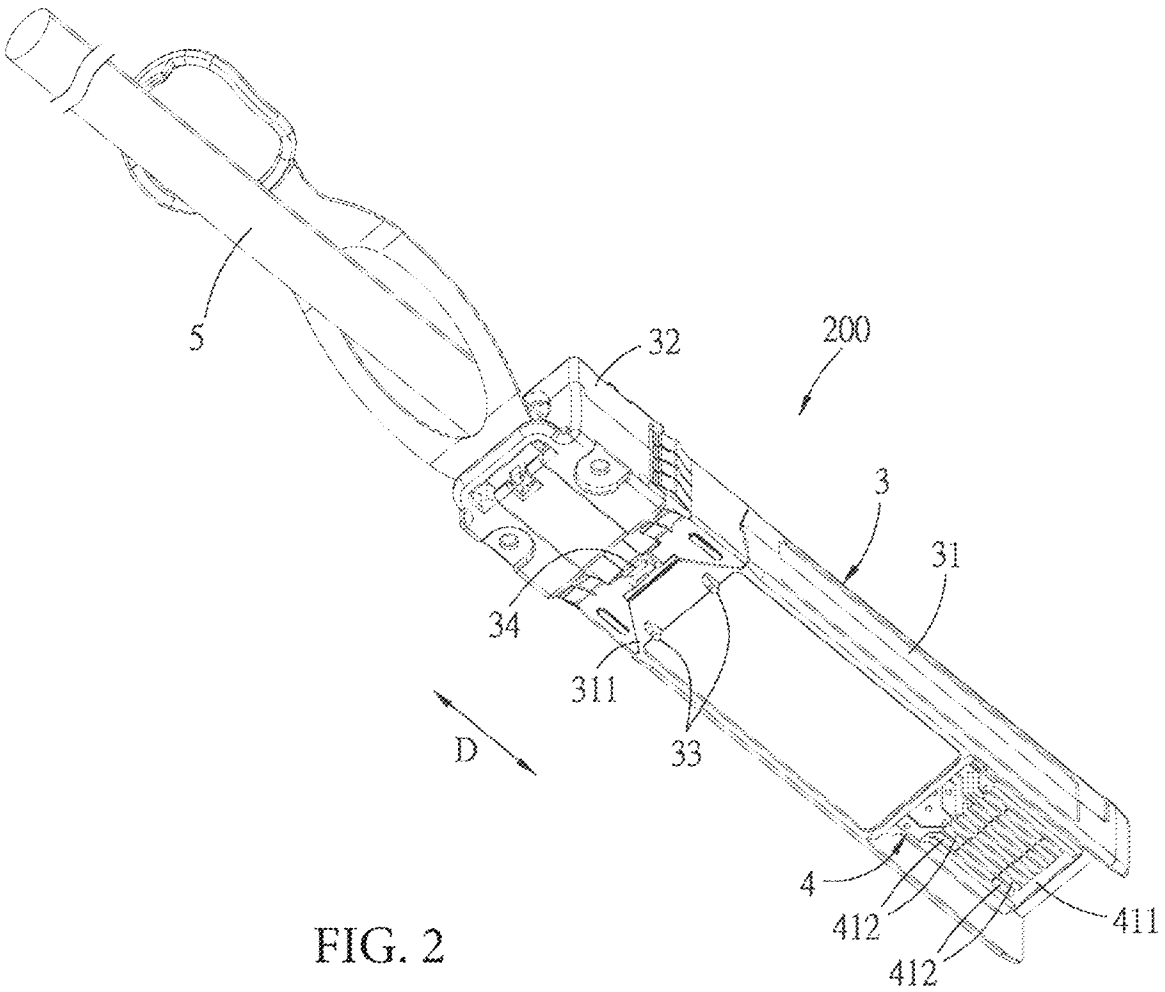
FIG. 2 is a perspective view of a plug assembly of the first embodiment.
Figure 3:
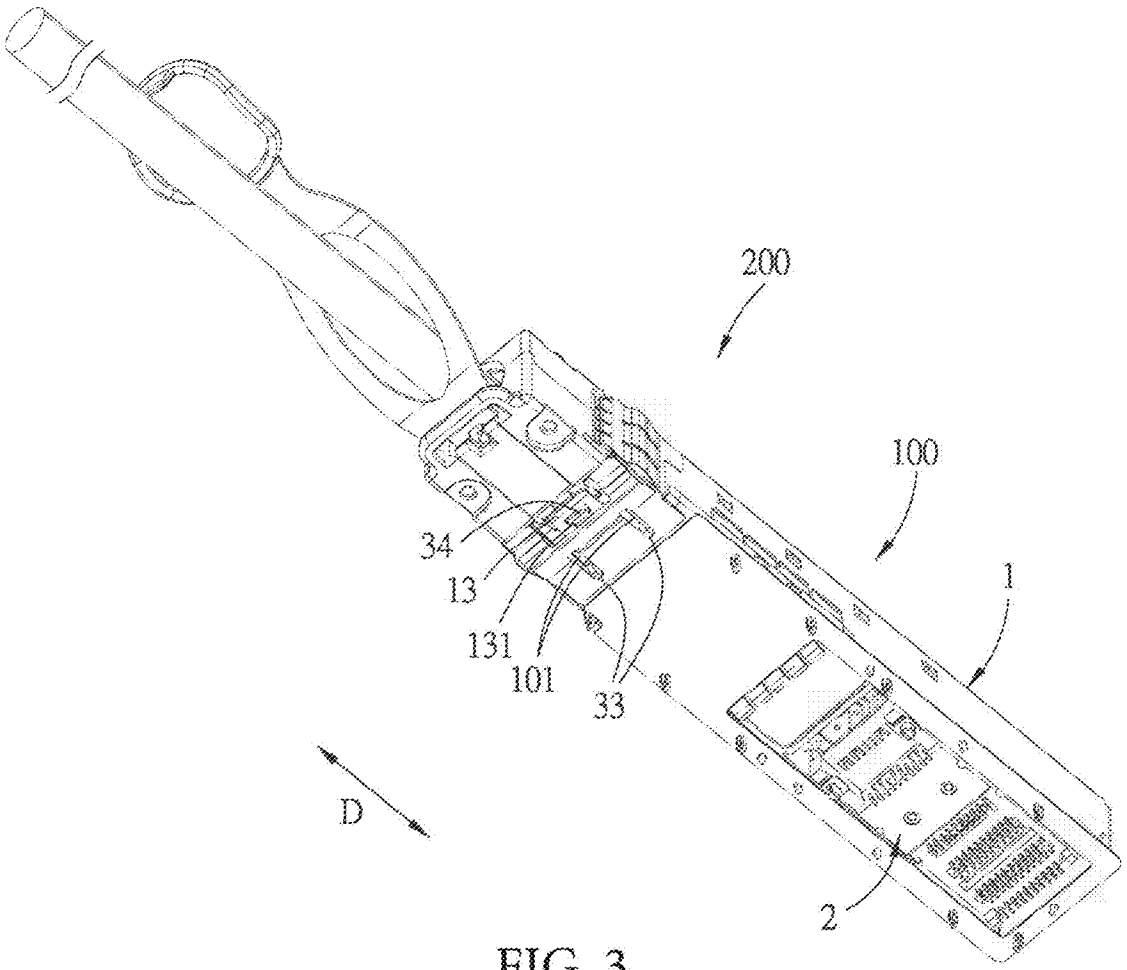
FIG. 3 is a perspective view illustrating a mated state of the receptacle assembly and the plug assembly of the first embodiment.
Figure 4:
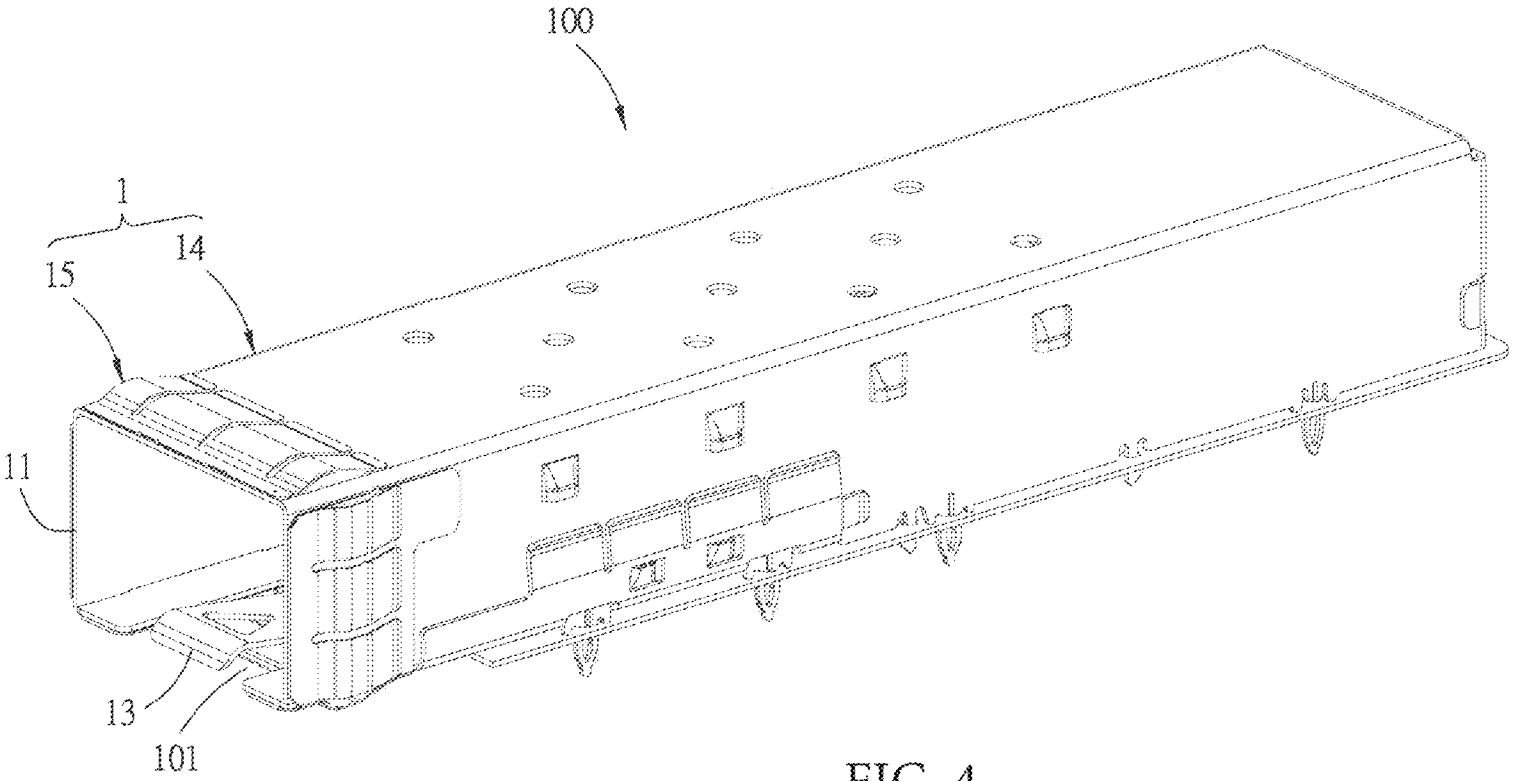
FIG. 4 is a perspective view of the receptacle assembly of the first embodiment.
Figure 5:
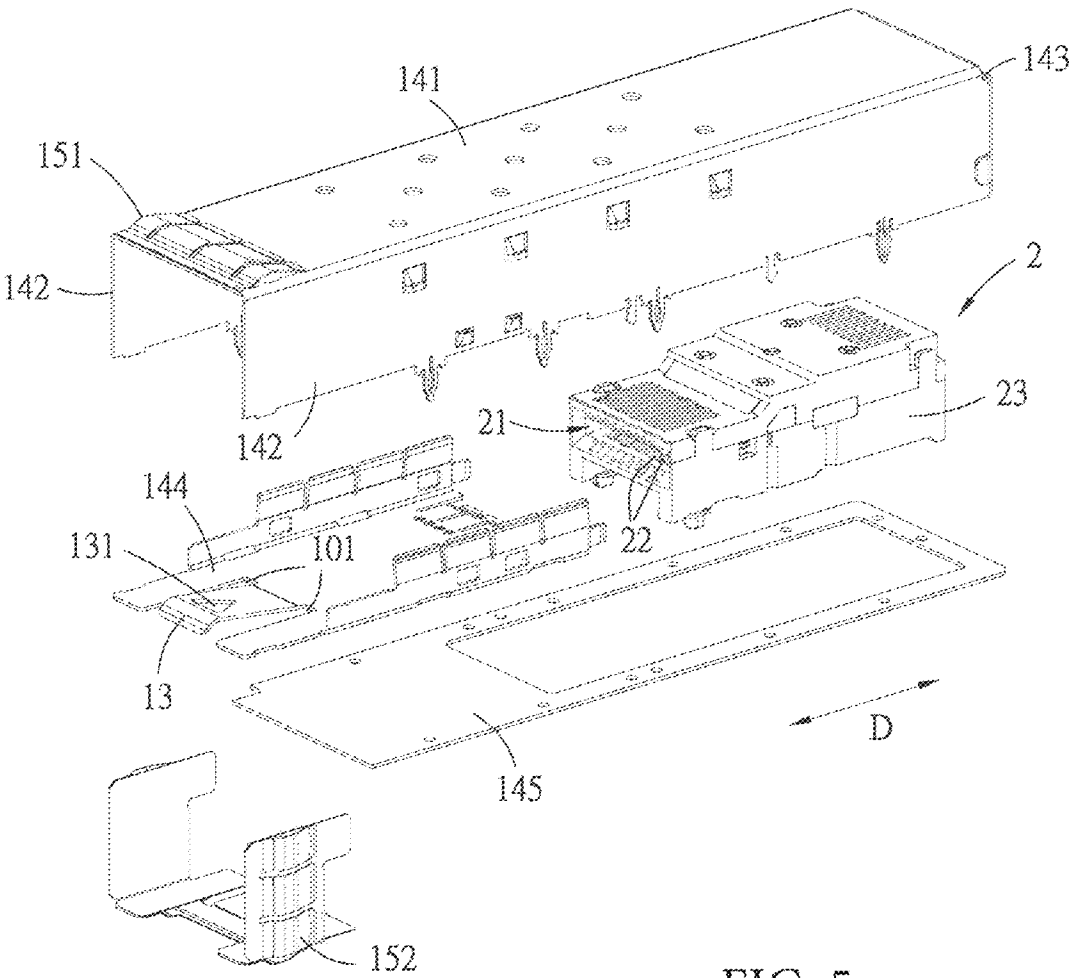
FIG. 5 is an exploded perspective view of the receptacle assembly of the first embodiment.
Figure 6:
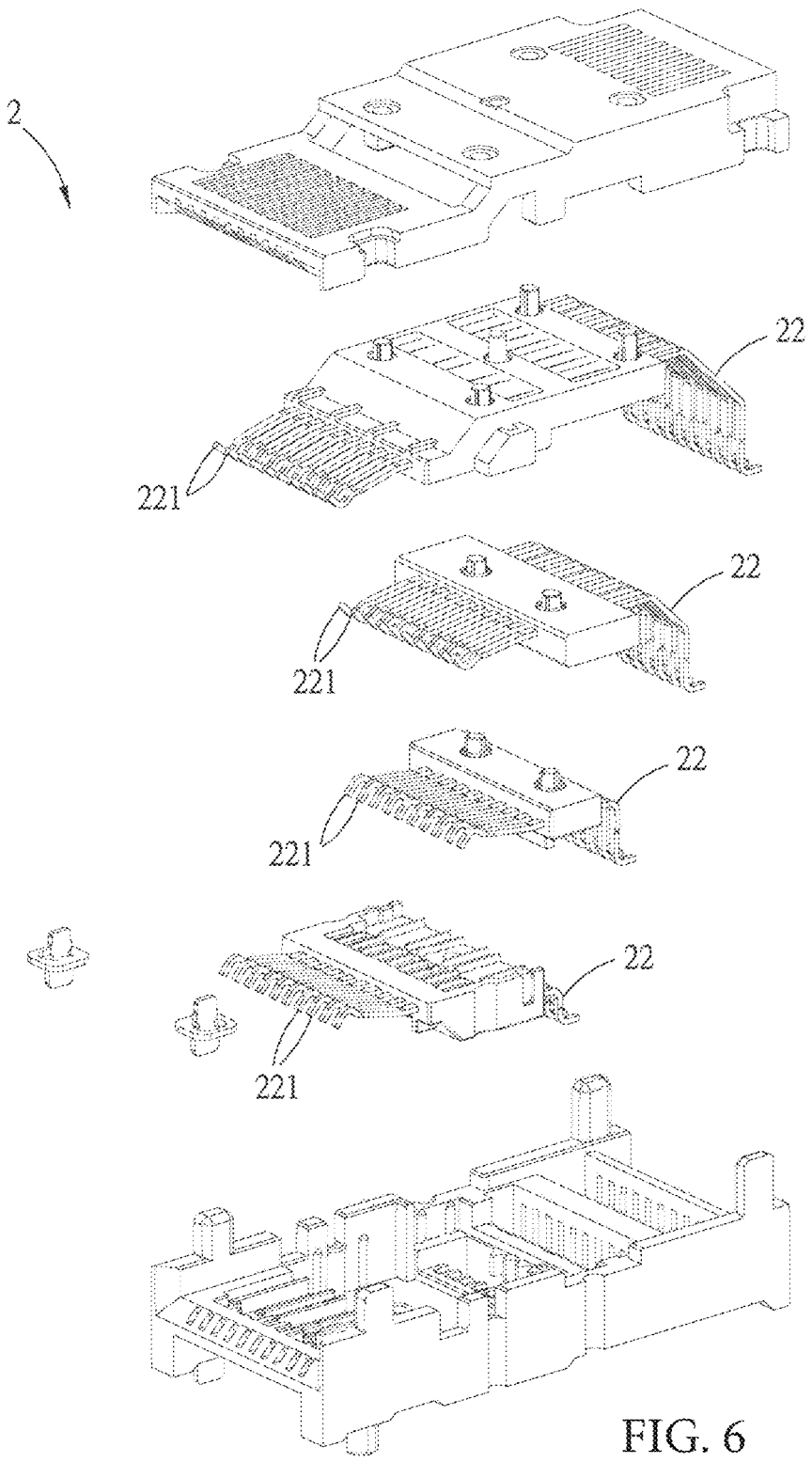
FIG. 6 is an exploded perspective view of a connector of the receptacle assembly of the first embodiment.
Figure 7:
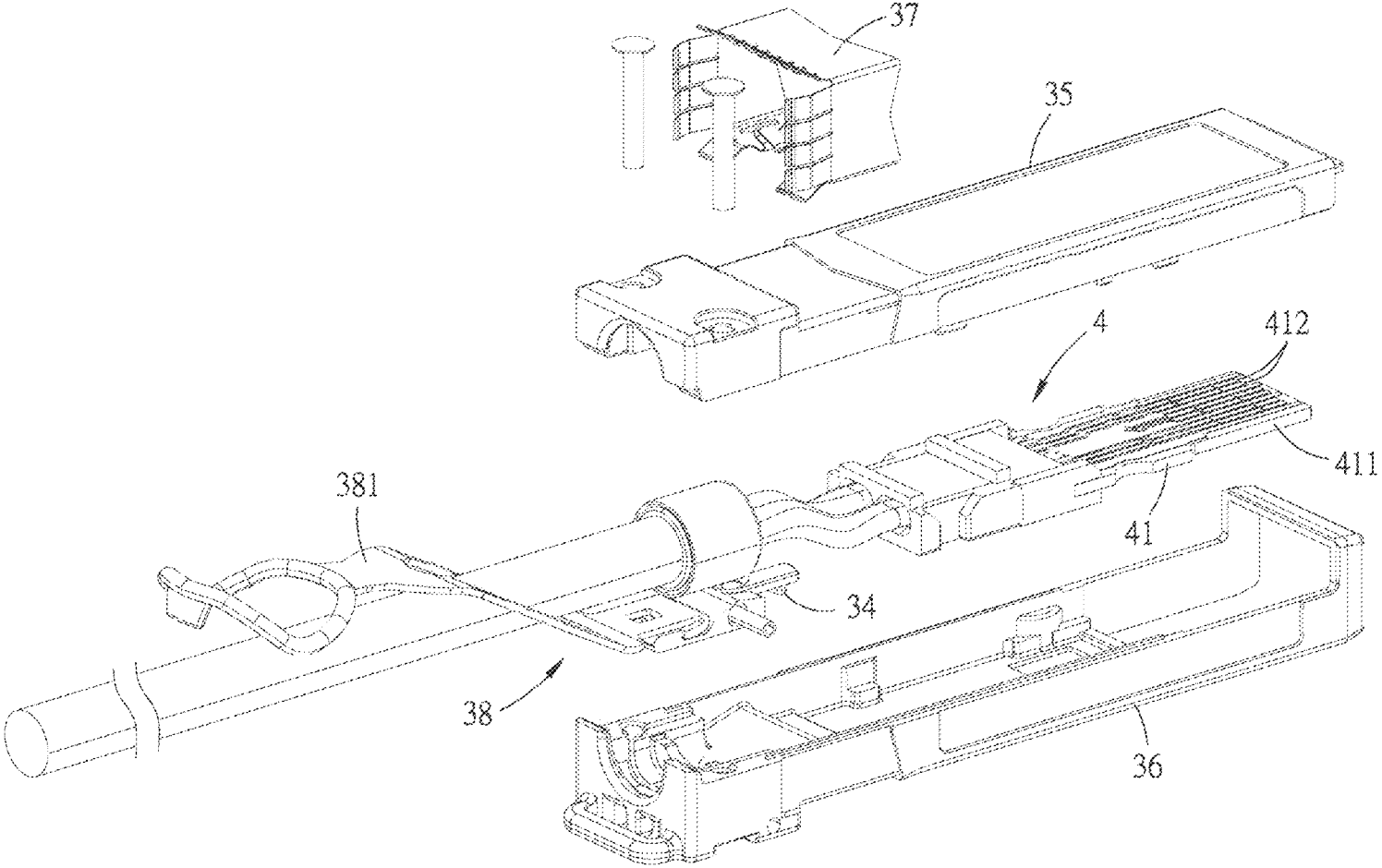
FIG. 7 is an exploded perspective view of the plug assembly of the first embodiment.
Figure 8:
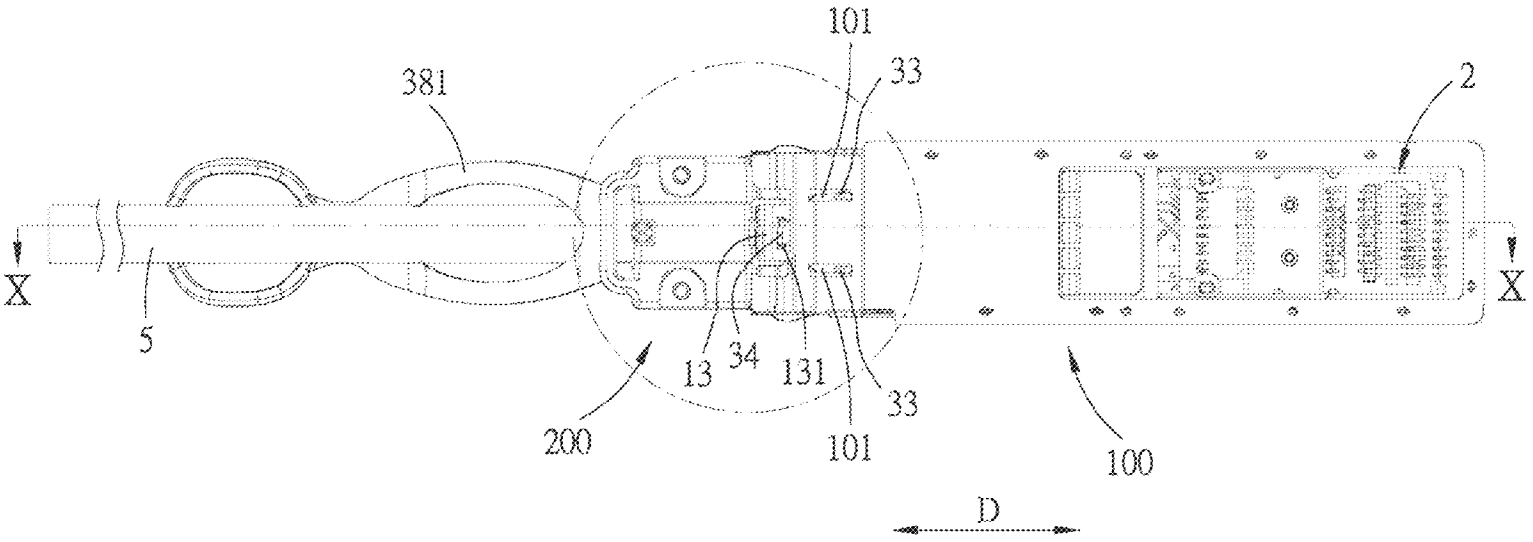
FIG. 8 is a bottom view illustrating a mated state of the receptacle assembly and the plug assembly of the first embodiment.
Figure 9:
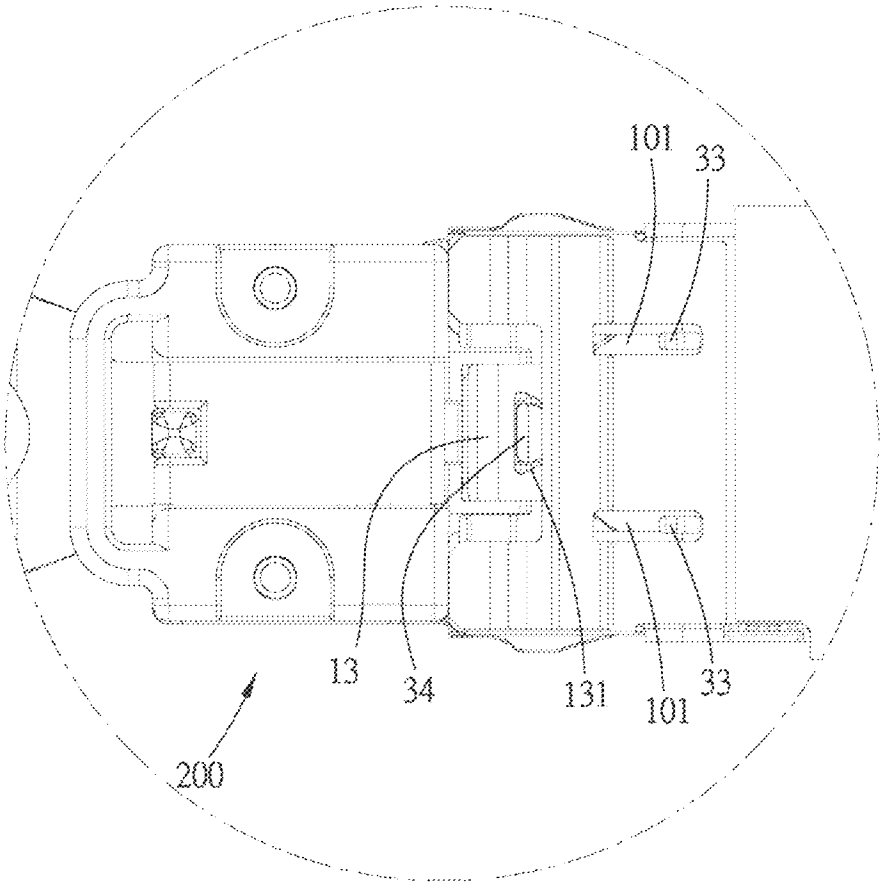
FIG. 9 is an enlarged view of a partial region in FIG. 8.
Figure 10:
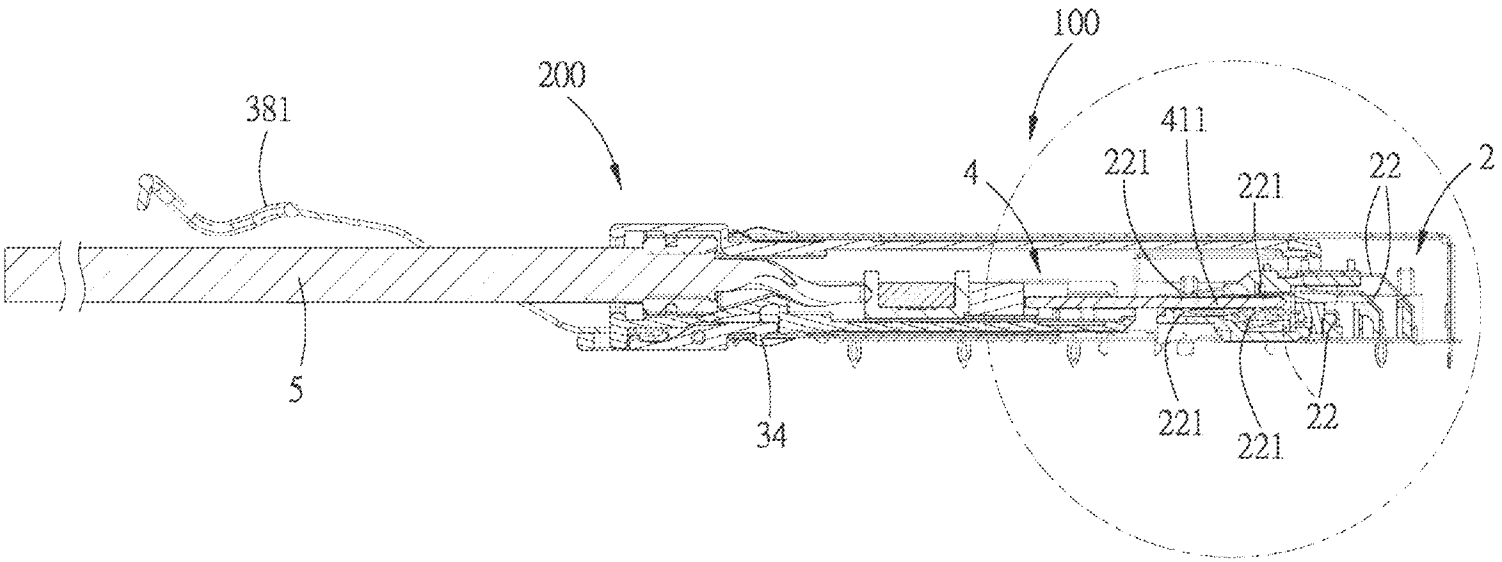
FIG. 10 is a cross-sectional view taken along a line X-X in FIG. 8.

Referring to FIG. 1 to FIG. 3, a first embodiment of an electrical connection device of the present disclosure comprises a receptacle assembly 100 and a plug assembly 200 which can be mated with each other.

Referring to FIG. 1, FIG. 4 to FIG. 6, the receptacle assembly 100 comprises a cage 1 and a connector 2. The cage 1 defines a port 11 positioned at a front end and an accommodating space 12 extending backwardly from the port 11 along a mating direction D. The receptacle assembly 100 is provided with at least one guide groove 101 extending along the mating direction D. In the first embodiment, the at least one guide groove 101 is provided to the cage 1, specifically, the cage 1 has two guide grooves 101 spaced apart from each other and a leaf spring 13 which is positioned between the two guide grooves 101 and has a lock opening 131, that is, each guide groove 101 is an open groove extending backwardly from the port 11 along the mating direction D on the cage 1, the leaf spring 13 which a free end is adjacent to the port 11 is formed by the two open grooves (that is the two guide grooves 101), in other words, inner sides of the two guide grooves 101 are respectively defined by two opposite sides of the leaf spring 13. Specifically, the cage 1 comprises a shell 14 and a grounding frame 15. The shell 14 has a top wall 141, two side walls 142 respectively connected to two sides of the top wall 141, a rear wall 143 connecting the top wall 141 and the two side walls 142 and facing the port 11, a bottom wall 144 connected to the two side walls 142 and facing the top wall 141 and a bottom frame plate 145 connected to the two side walls 142 and the rear wall 143, a front section of bottom frame plate 145 is overlapped with the bottom wall 144. The bottom wall 144, the top wall 141 and the two side walls 142 together define the port 11, and the two guide grooves 101 are formed to the bottom wall 144. The grounding frame 15 comprises an upper frame portion 151 and a lower frame portion 152, the upper frame portion 151 and the lower frame portion 152 together surround a periphery of the shell 14 adjacent to the port 11.

Figure 11:
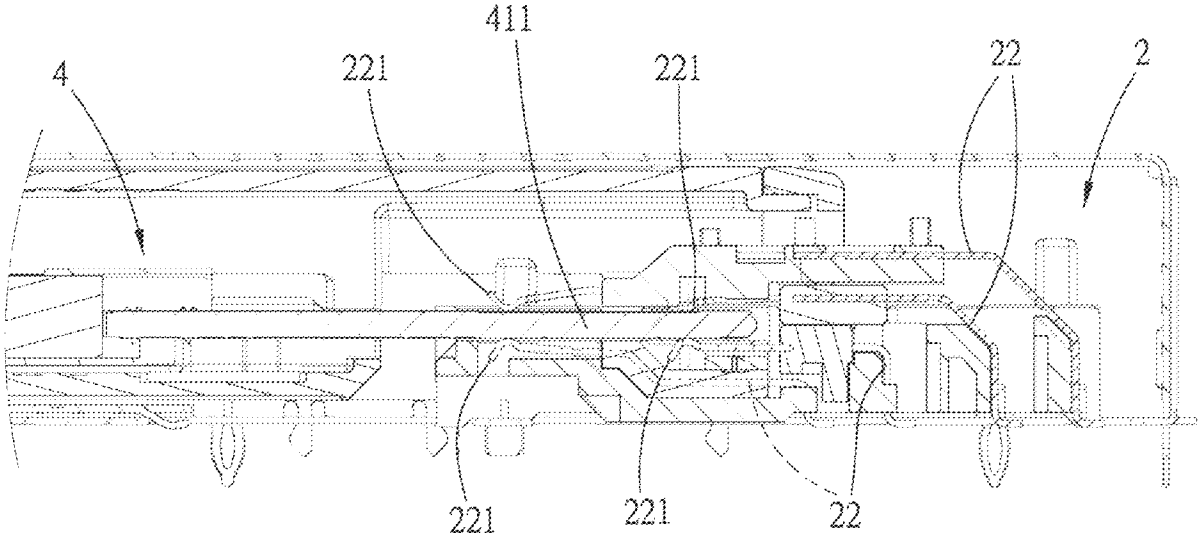
FIG. 11 is an enlarged view of a partial region in FIG. 10.

The connector 2 is positioned in the accommodating space 12 and has an insulating body 23 and a slot 21 defined by the insulating body 23, an entrance of the slot 21 is aligned with the port 11 and extends backwardly along the mating direction D. The connector 2 also has a plurality of terminals 22 provided to the insulating body 23 and arranged in four rows, each terminal 22 has an elastic contact portion 221 extending into the slot 21, the elastic contact portions 221 of the plurality of terminals 22 are arranged in front two rows and back two rows in the mating direction D in the slot 21, the front two rows face each other in the up-down direction and the back two rows face each other in the up-down direction (referring to FIG. 11).

Referring to FIG. 2 and FIG. 7 to FIG. 11, the plug assembly 200 comprises an outer housing 3 and a communication module 4 provided in the outer housing 3. The communication module 4 can be an electronic module transmitting an electrical signal or a photoelectric module transmitting a photoelectric signal. The outer housing 3 has a main body 31 which can be inserted into the cage 1 along the mating direction D to be mated with the connector 2 and a cable connection portion 32 which is used to retain a cable 5. The communication module 4 has a circuit board 41 positioned in the main body 31, and the circuit board 41 has a mating end portion 411 used to be inserted into the slot 21, the mating end portion 411 is provided with totally four rows of conductive pads 412 which are respectively arranged in front two rows and back two rows in the mating direction D on opposite two board surfaces of the mating end portion 411, so as to respectively correspond to the elastic contact portions 221 of the four rows of terminals of the connector 2. The outer housing 3 further has two guide blocks 33 which protrude from a bottom face 311 of the main body 31 and respectively correspond to the two guide grooves 101 and a lock block 34 which is used to be detachably latched to the lock opening 131. When the plug assembly 200 is mated with the receptacle assembly 100, the two guide blocks 33 respectively enter into the two guide grooves 101 (see FIG. 8 and FIG. 9), and the lock block 34 is latched to the lock opening 131 to make the plug assembly 200 and the receptacle assembly 100 fixed relative to each other in the mating direction D. That is, a width of each guide block 33 is smaller than a width of each guide groove 101, and the two guide blocks 33 are respectively aligned with the two guide grooves 101 in the mating direction D, in the process that the plug assembly 200 is mated with the receptacle assembly 100, the two guide blocks 33 respectively enter into the two guide grooves 101 and moves from front to back, until the plug assembly 200 and the receptacle assembly 100 are positioned relative to each other, at this time the mating end portion 411 is inserted into the slot 21 such that the plurality of elastic contact portions 221 respectively contact the plurality of conductive pads 412 to form an electrical connection, and the lock block 34 is latched to the lock opening 131 to make the plug assembly 200 and the receptacle assembly 100 locked relative to each other. Specifically, the outer housing 3 comprises an upper housing piece 35, a lower housing piece 36, a grounding piece 37 and a release mechanism 38. The upper housing piece 35 and the lower housing piece 36 are combined to together form the main body 31 and the cable connection portion 32. The grounding piece 37 is sheathed on the main body 31, the grounding piece 37 can contact the grounding frame 15 of the receptacle assembly 100 when the plug assembly 200 is mated with the receptacle assembly 100. The release mechanism 38 is connected with the lock block 34 and has a pull tab 381, when the pull tab 381 is pulled, and the lock block 34 can be moved into the outer housing 3 by using the seesaw lever principle, so that the lock block 34 can be detached from the lock opening 131 to be released.

In the first embodiment, the receptacle assembly 100 is described as an example receptacle conforming to a SFP-DD specification, and the plug assembly 200 is described as an example plug conforming to the SFP-DD specification.

Figure 12:
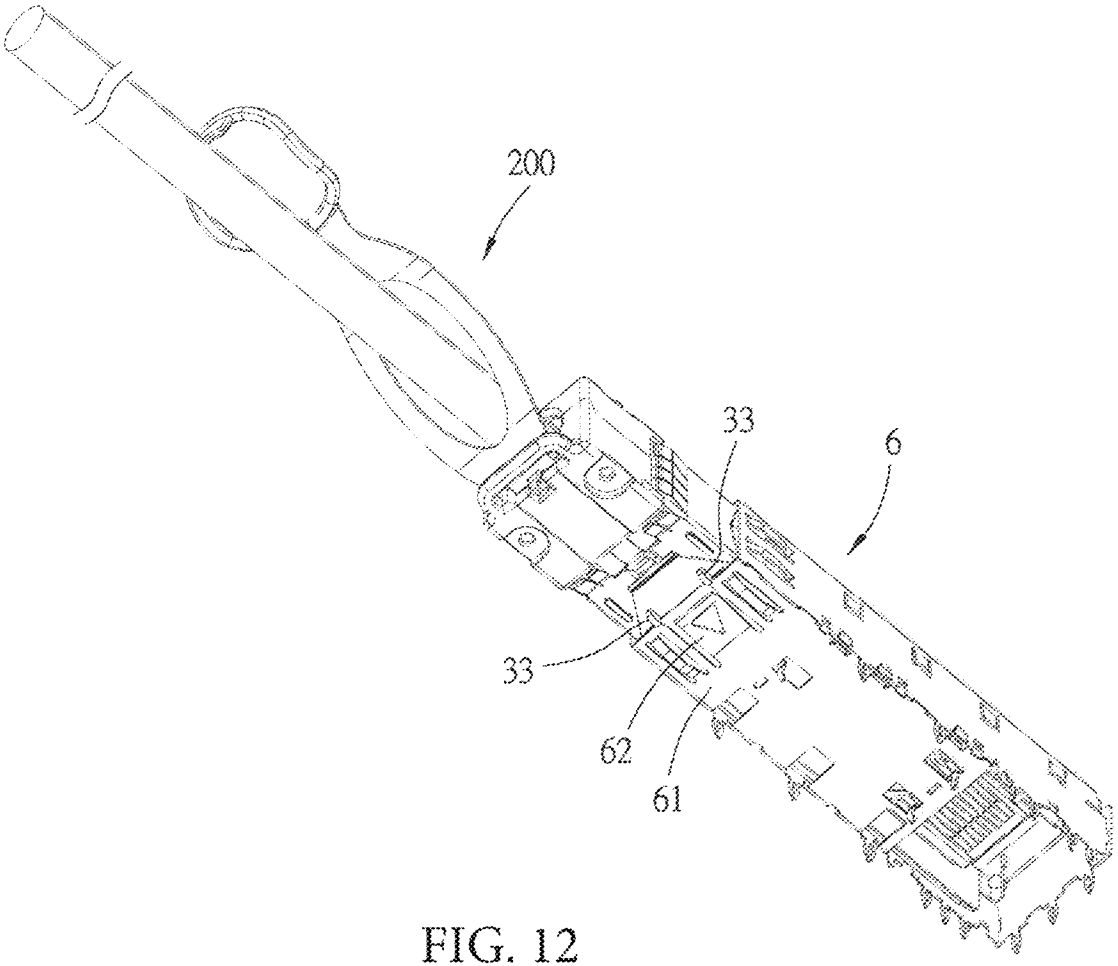
FIG. 12 is a perspective view illustrating that the plug assembly of the first embodiment and a conventional SFP receptacle can not be inserted into each other.
Figure 13:
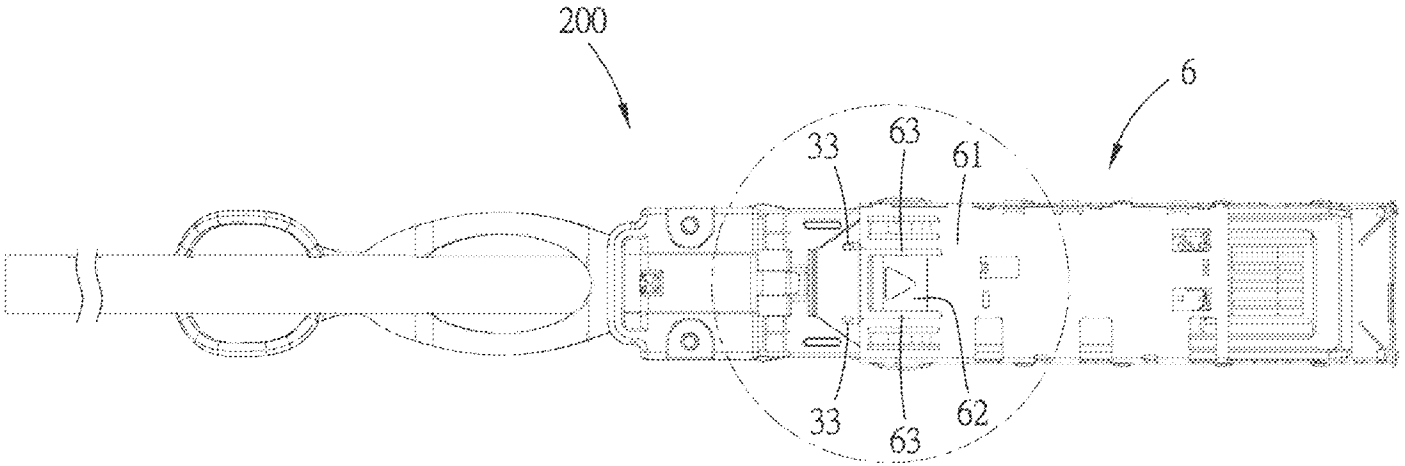
FIG. 13 is a bottom view corresponding to FIG. 12.
Figure 14:
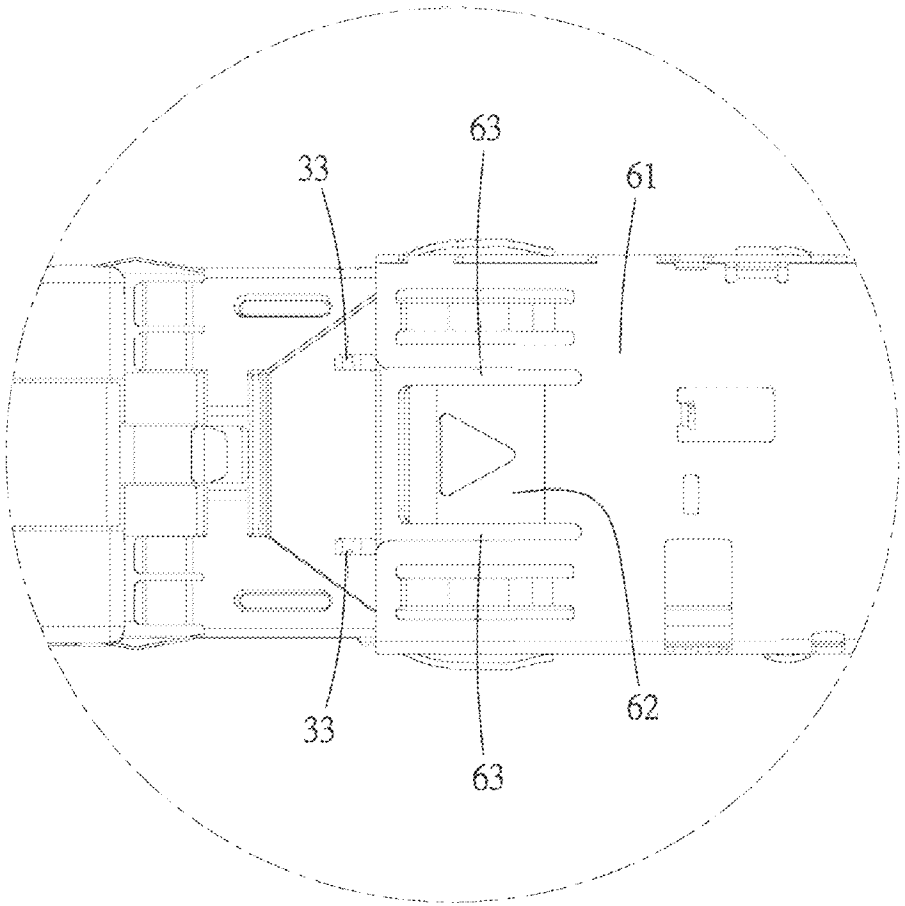
FIG. 14 is an enlarged view of a partial region in FIG. 13.

Referring to FIG. 12 to FIG. 14, when the plug assembly 200 of the first embodiment is to be inserted into a conventional SFP receptacle 6, since the conventional SFP receptacle 6 has no corresponding guide groove, the two guide blocks 33 may be stopped by a front edge of a bottom wall 61 of the SFP receptacle 6, such that the plug assembly 200 cannot be inserted into the SFP receptacle 6, so as to achieve the function of preventing improper insertion. That is, although two sides of a leaf spring 62 of the conventional SFP receptacle 6 respectively have two torn seams 63, positions and widths of the two torn seams 63 do not correspond to the two guide blocks 33, thus the two torn seams 63 cannot respectively accommodate the two guide blocks 33, such that the two guide blocks 33 cannot pass through a port of the SFP receptacle 6.

Figure 15:
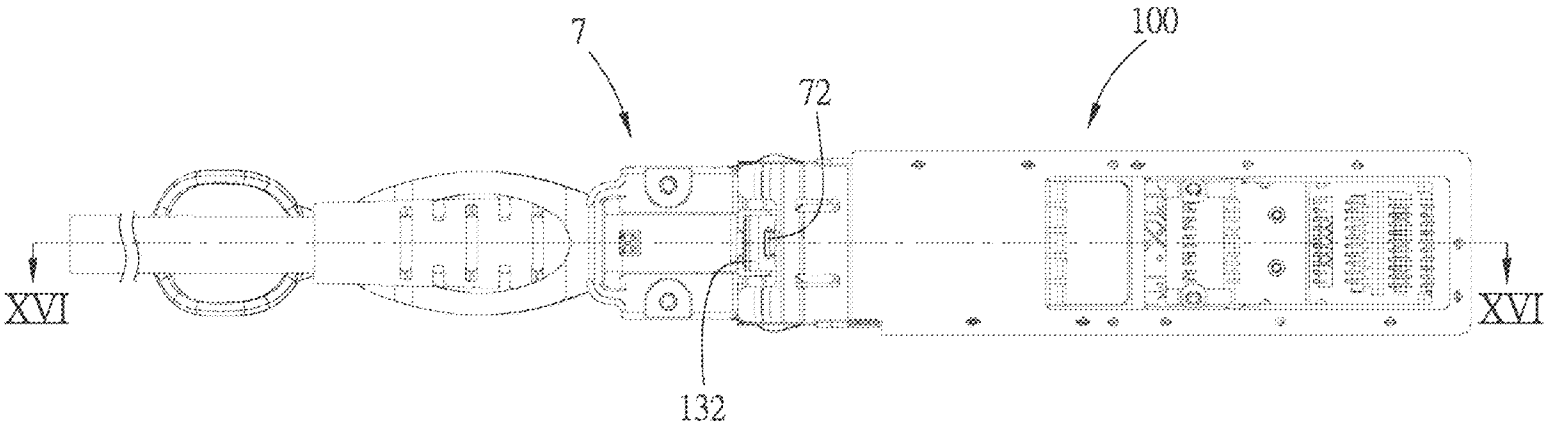
FIG. 15 is a bottom view illustrating that the receptacle assembly of the first embodiment can be compatible with a conventional SFP plug.
Figure 16:
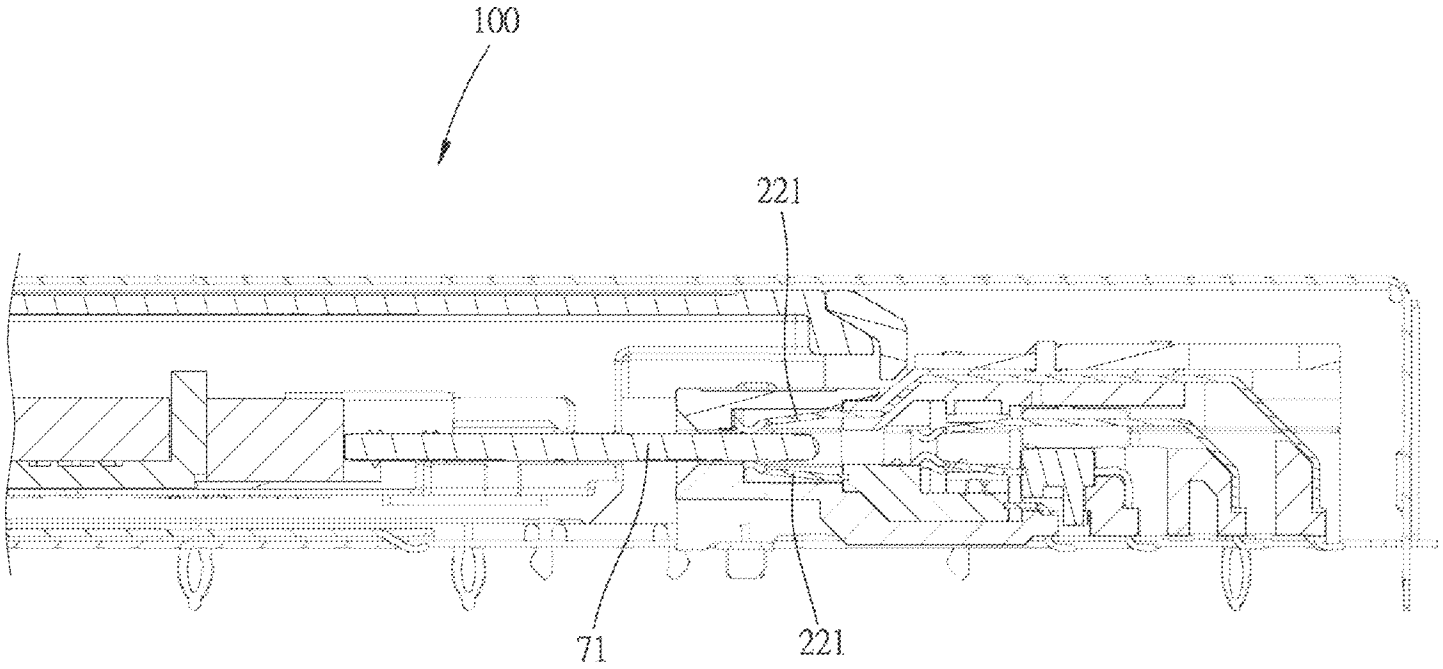
FIG. 16 is a partial cross-sectional view taken along a line XVI-XVI in FIG. 15.

Referring to FIG. 15 and FIG. 16, the receptacle assembly 100 of the first embodiment can also be compatible with the conventional SFP plug 7, since the conventional SFP plug 7 has no guide block, the SFP plug 7 can be inserted into the receptacle assembly 100, such that the elastic contact portions 221 in the front two rows in the receptacle assembly 100 and a mating end portion 71 of the SFP plug 7 form an electrical connection. And a position of the leaf spring 13 of the first embodiment is the same as a position of the leaf spring 62 of the conventional SFP receptacle 6 (see FIG. 12), and thus the leaf spring 13 of the first embodiment can be locked and fixed with a lock block 72 of the SFP plug 7.

Figure 17:
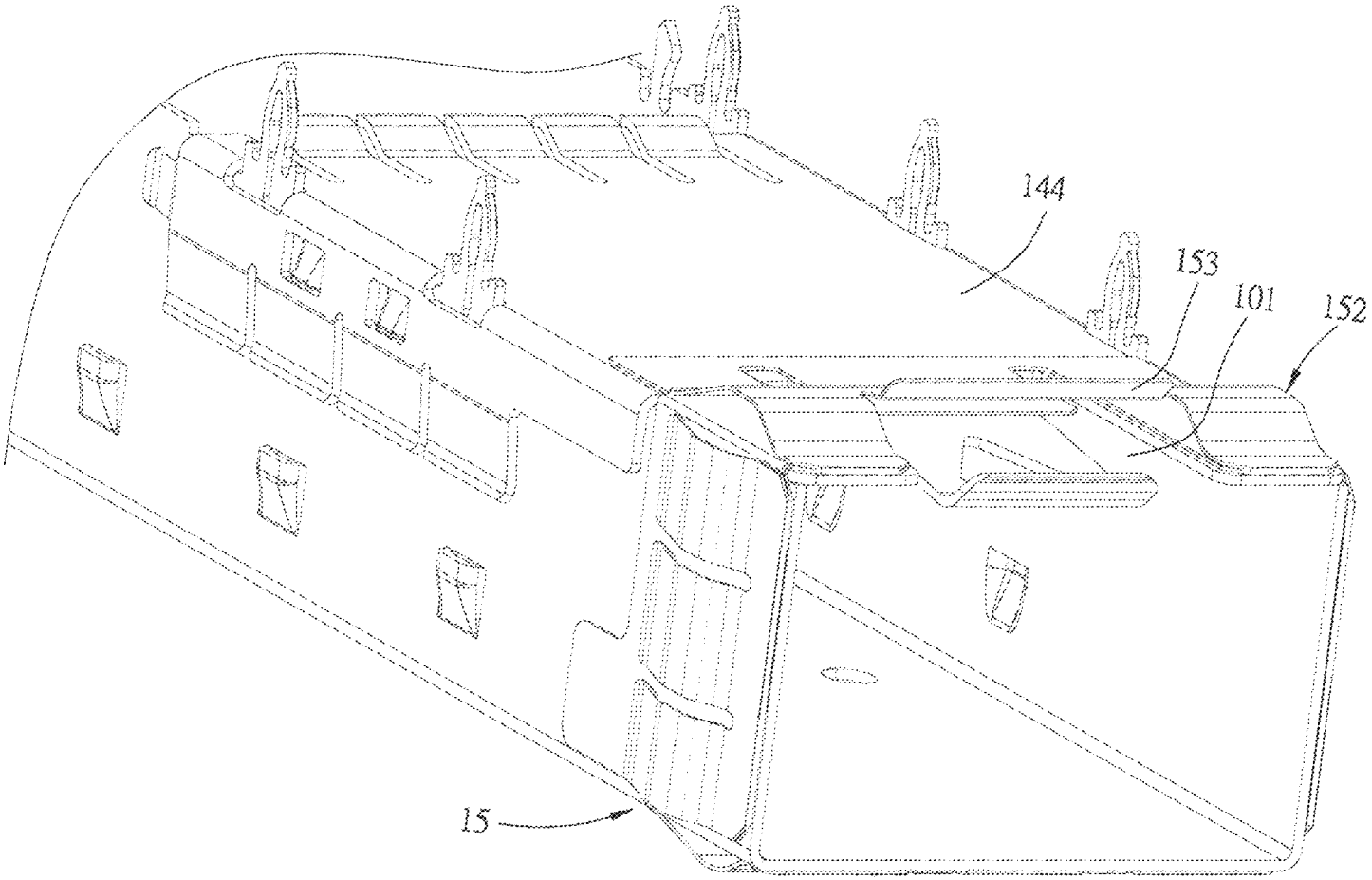
FIG. 17 is an incomplete perspective view illustrating a varied embodiment of a grounding frame of the first embodiment.
Figure 18:
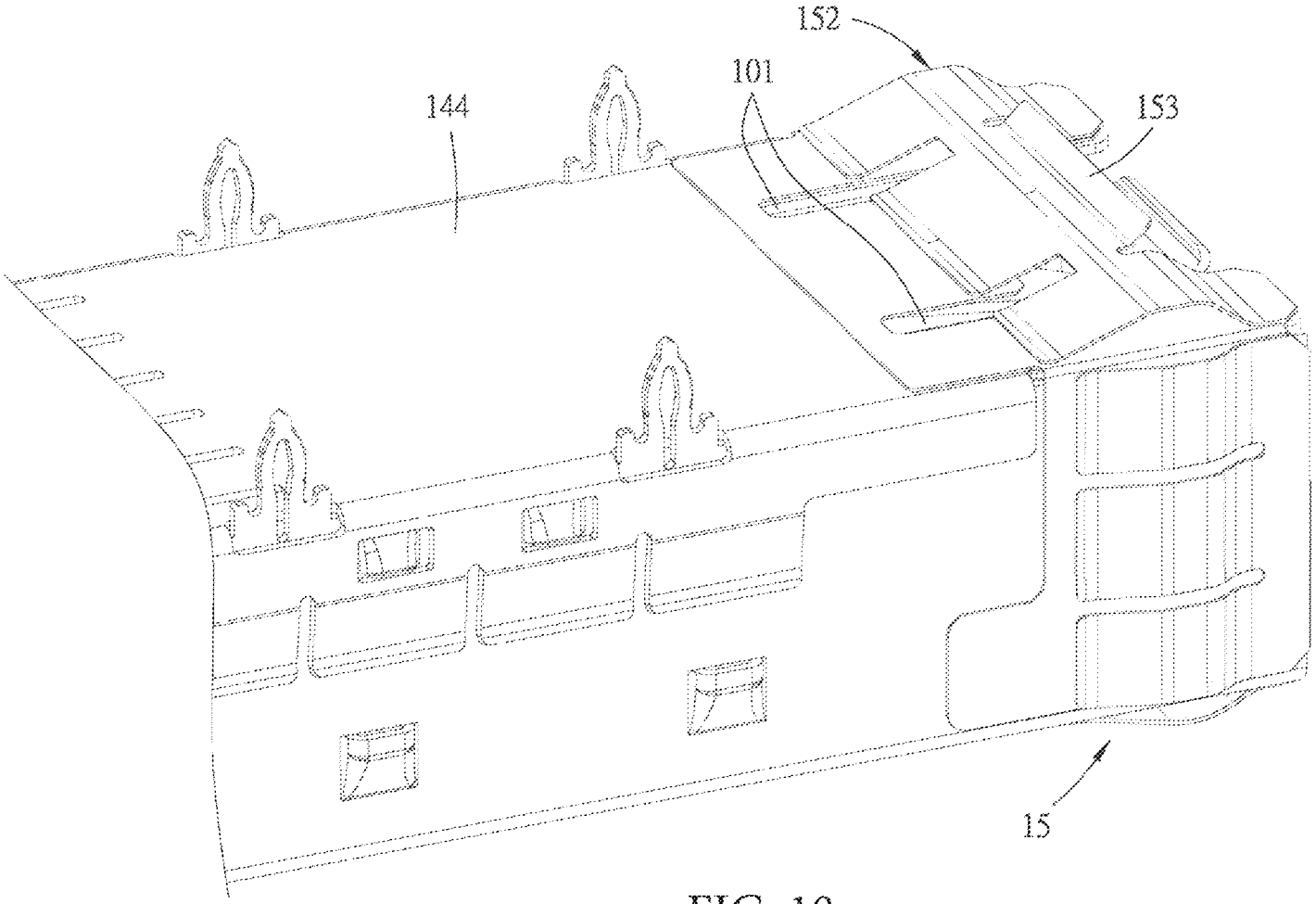
FIG. 18 is a view of FIG. 17 from another angle.

Referring to FIG. 17 and FIG. 18, a varied embodiment of the grounding frame 15 is illustrated, in which a portion of the lower frame portion 152 overlapped with the bottom wall 144 is formed with a guide portion 153 used to guide the two guide blocks 33 (see FIG. 3). After the two guide blocks 33 respectively enter into the corresponding guide grooves 131, the two guide blocks 33 can pass through a front edge of the lower frame portion 152 by means of guiding from the guide portion 153, preventing the two guide blocks 33 striking the front edge of the lower frame portion 152, and the guide block 33 can move smoothly.

Figure 19:
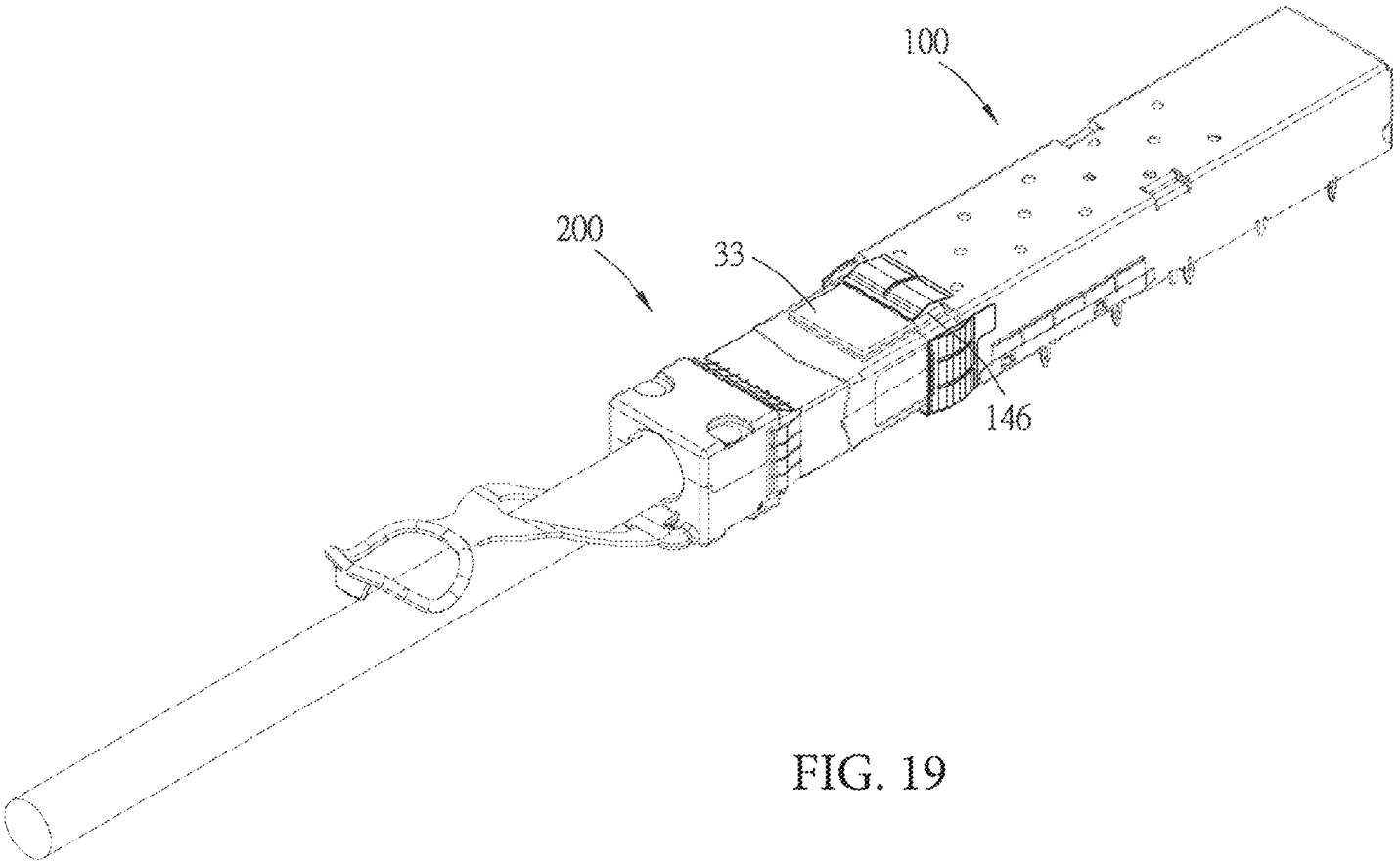
FIG. 19 is a perspective view of a second embodiment of the electrical connection device of the present disclosure.
Figure 20:
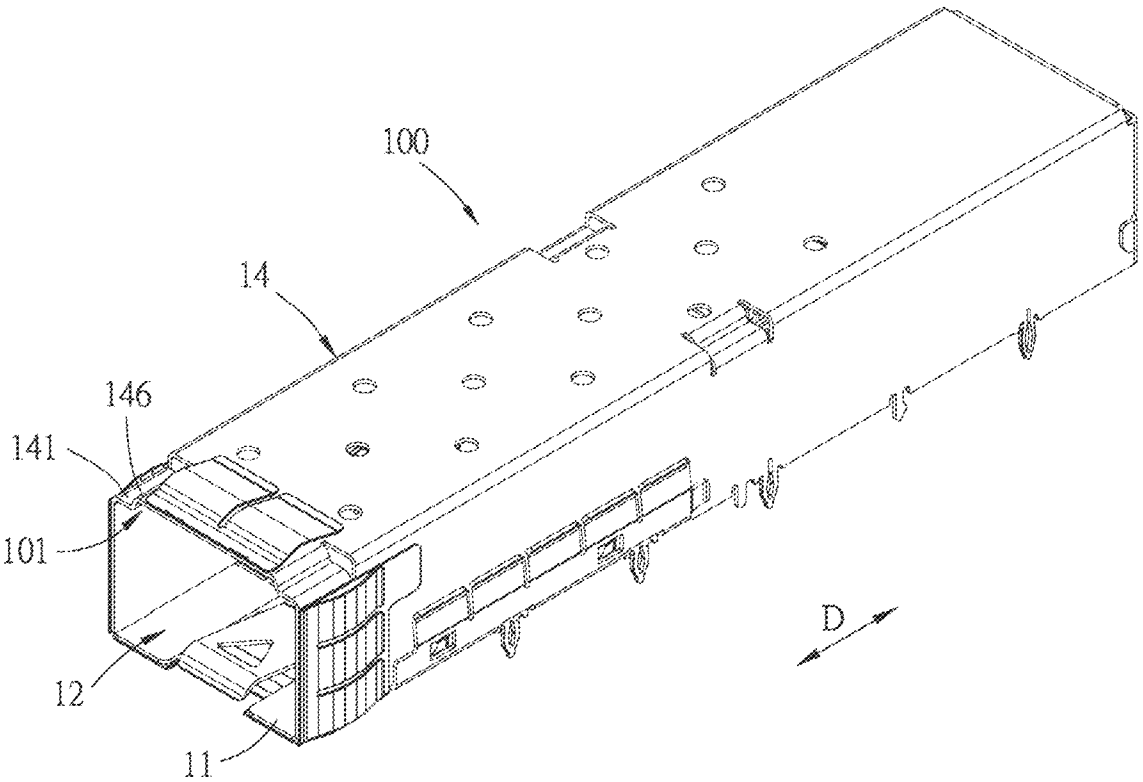
FIG. 20 is a perspective view of a receptacle assembly of the second embodiment.
Figure 21:
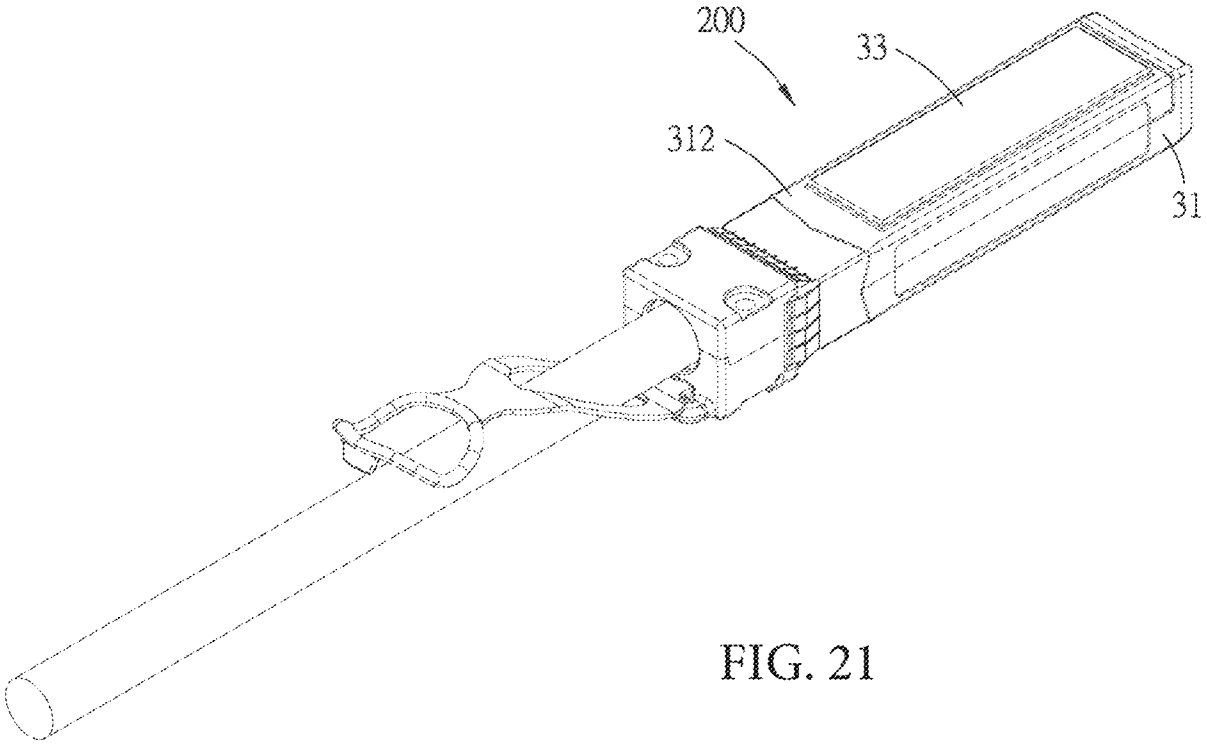
FIG. 21 is a perspective view of a plug assembly of the second embodiment.
Figure 22:
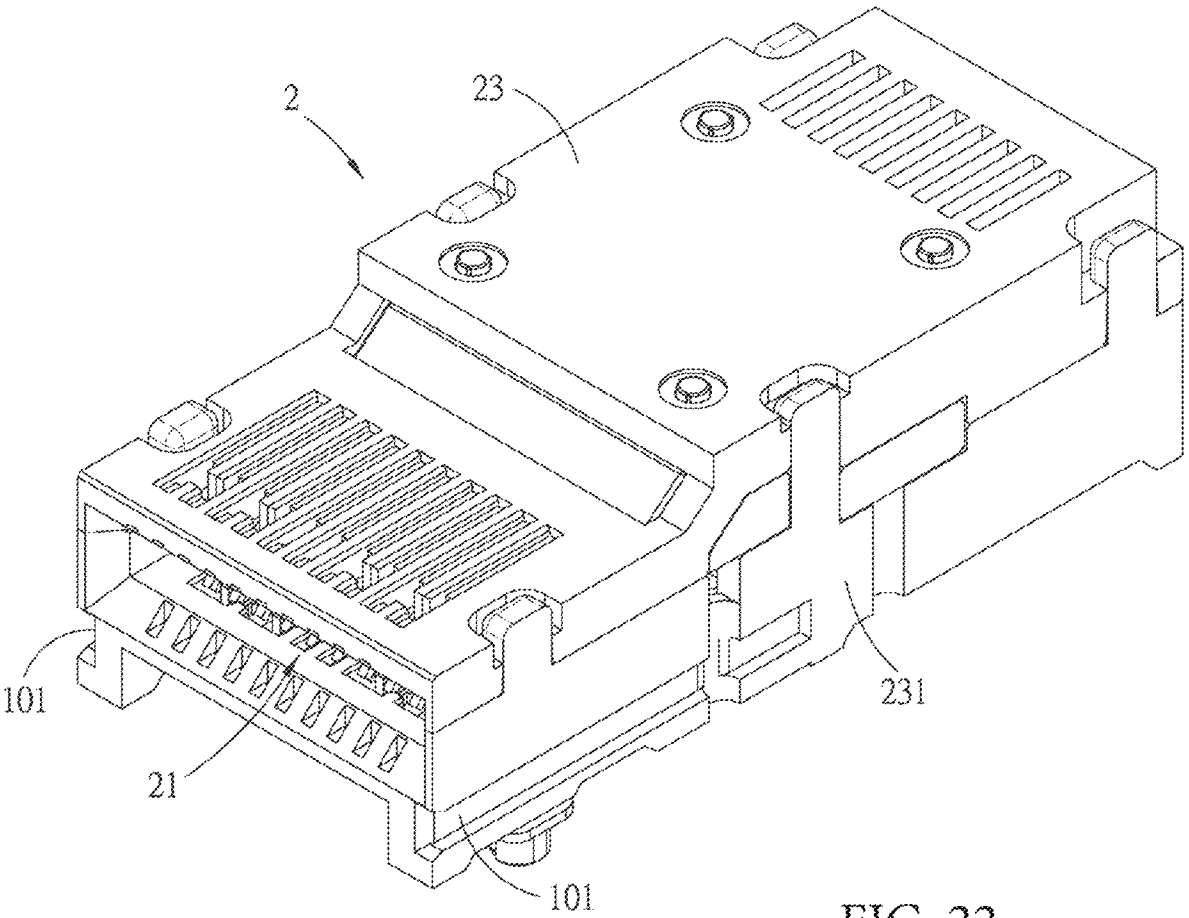
FIG. 22 is a perspective view of a connector of the receptacle assembly of a third embodiment of the electrical connection device of the present disclosure.
Figure 23:
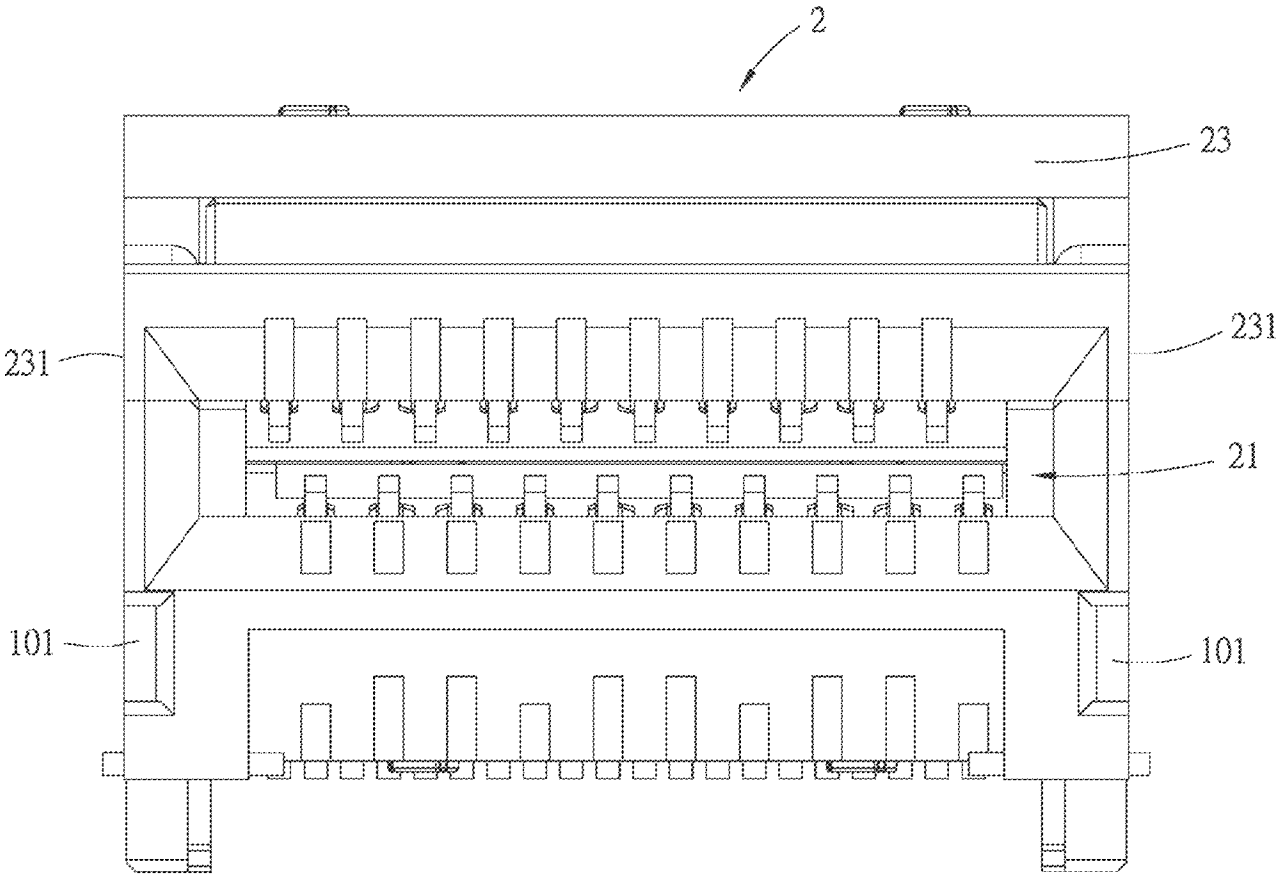
FIG. 23 is a front view corresponding to FIG. 22.
Figure 24:
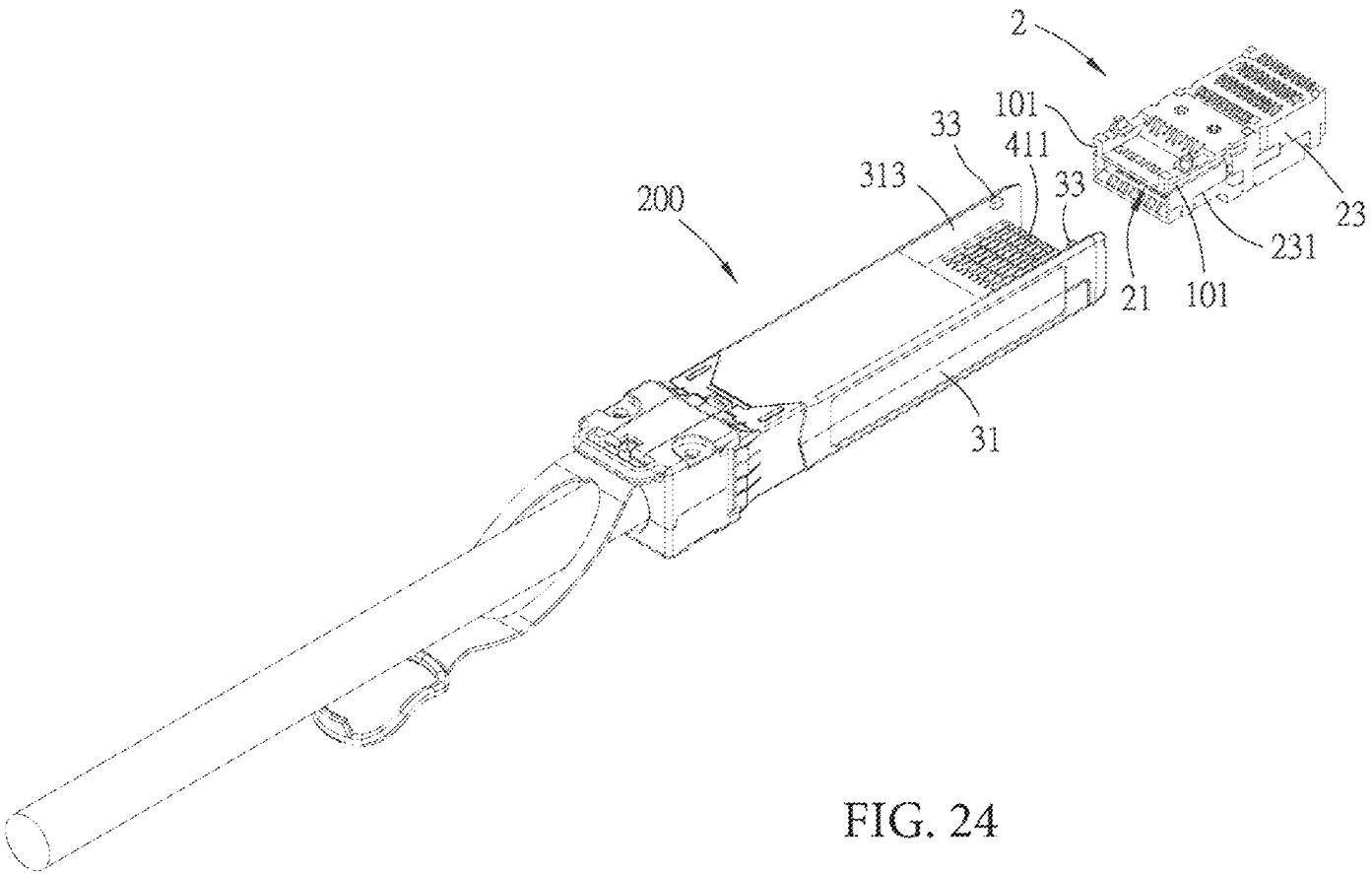
FIG. 24 is an exploded perspective view illustrating a mating relationship of the plug assembly and the connector of the third embodiment.
Figure 25:
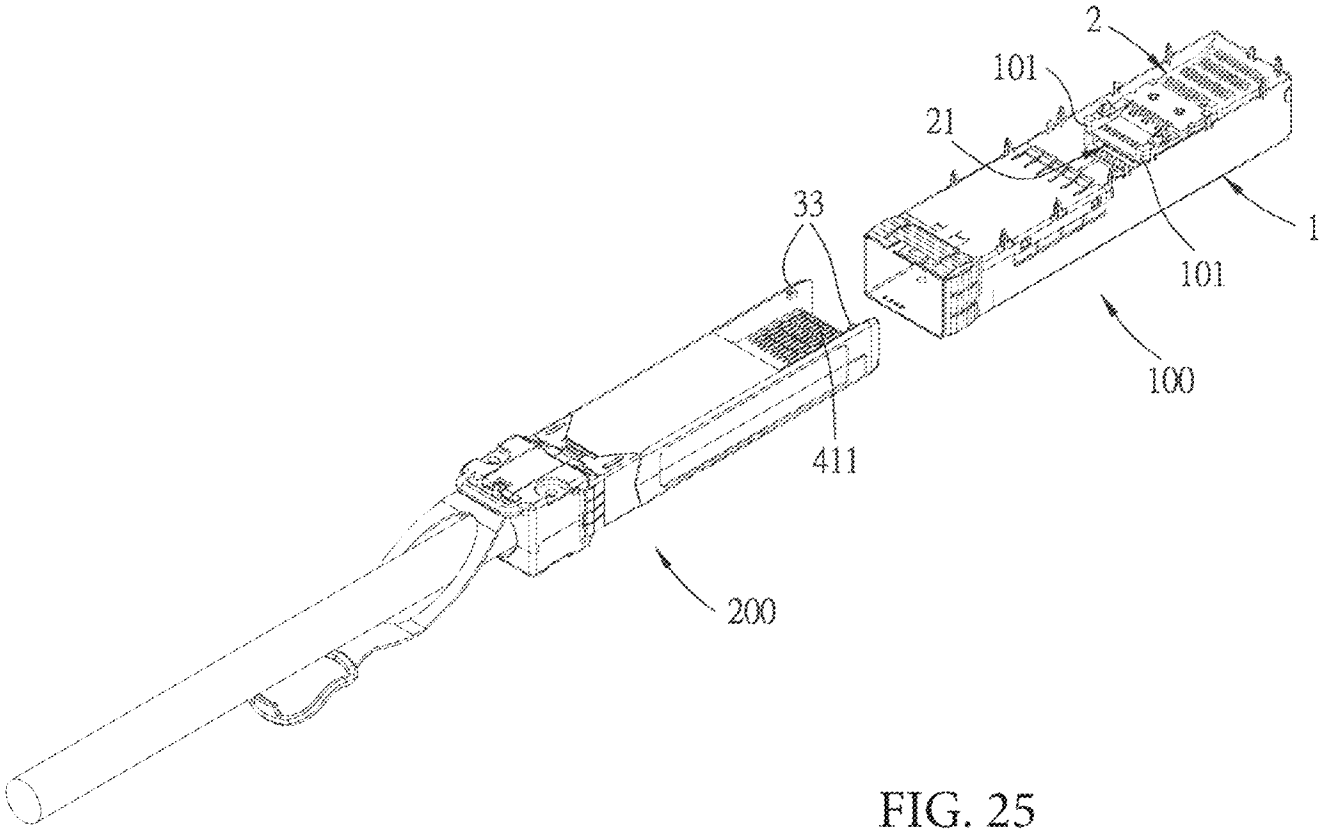
FIG. 25 is an exploded perspective view illustrating a mating relationship of the plug assembly and the receptacle assembly of the third embodiment.
Figure 26:
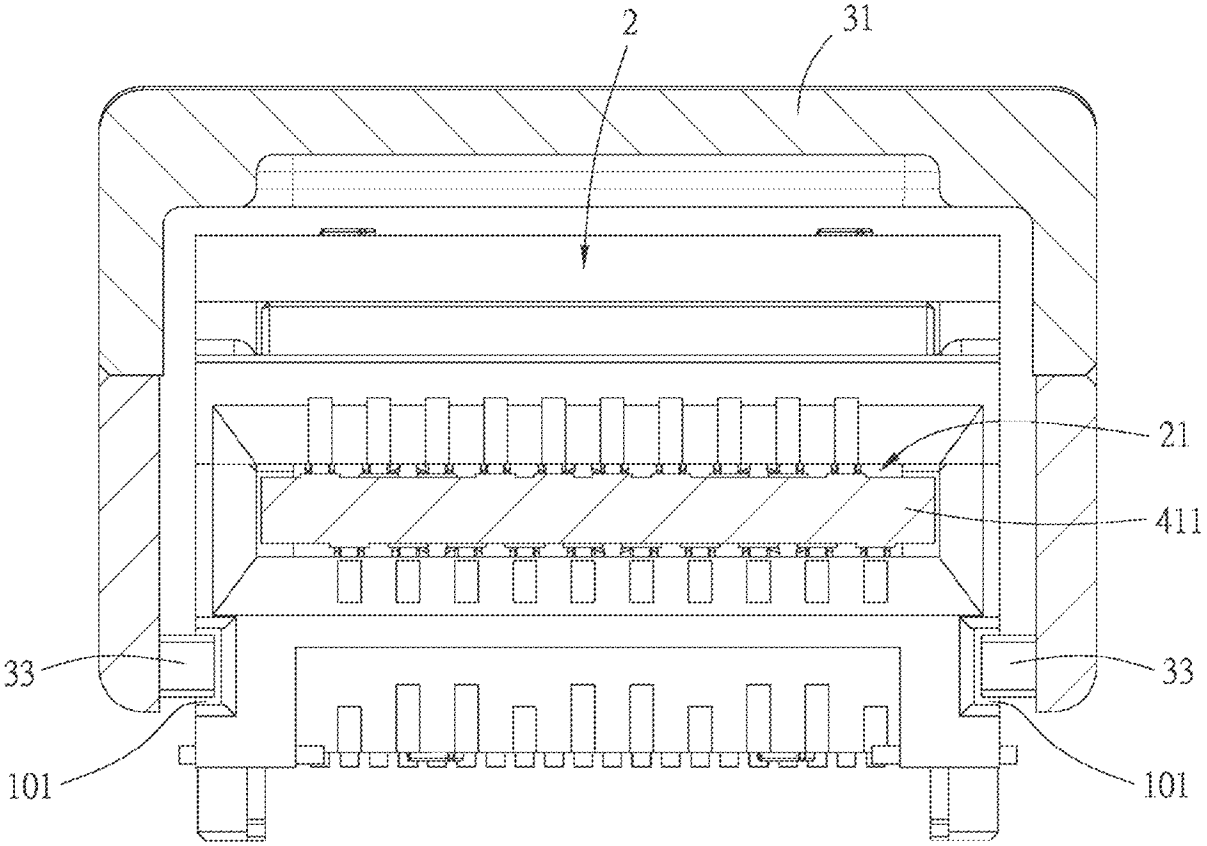
FIG. 26 is a cross-sectional view illustrating a mated state of the plug assembly and the connector of the receptacle assembly of the third embodiment.

Referring to FIG. 19 to FIG. 21, a second embodiment of the electrical connection device of the present disclosure differs from the first embodiment in that, in the second embodiment, the receptacle assembly 100 has only one guide groove 101, the plug assembly 200 has only one guide block 33, and the guide groove 101 extends backwardly from the port 11 along the mating direction D and is defined by an avoiding portion 146. Specifically, the main body 31 of the plug assembly 200 has a top face 312, the guide block 33 is a boss protruding from the top face 312, the avoiding portion 146 is formed to the top wall 141 of the shell 14 and defines the guide groove 101 extending backwardly from the port 11 along the mating direction D to accommodate the guide block 33 correspondingly. That is, the avoiding portion 146 expands the accommodating space 12 outwardly at the side walls 142 to add a space for accommodating the guide block 33 (boss), therefore the plug assembly 200 can enter the port 11 to be mated with the connector 2 (see FIG. 5) when the plug assembly 200 is mated with the receptacle assembly 100. Similarly, in the second embodiment, the plug assembly 200 cannot be inserted into the SFP receptacle generally having no corresponding guide groove, when the plug assembly 200 is to be inserted into the conventional SFP receptacle, the guide block 33 is stopped by the front edge of the top wall of the SFP receptacle, so that the plug assembly 200 cannot be inserted into the SFP receptacle so as to achieve the function of preventing improper insertion.

Referring to FIG. 22 to FIG. 26, a third embodiment of the electrical connection device of the present disclosure differs from the first embodiment in that, in the third embodiment, the at least one guide groove 101 of the receptacle assembly 100 is provided to the connector 2, and a position of the guide block 33 of the plug assembly 200 is adjusted corresponding to the guide groove 101. Specifically, in the third embodiment, the insulating body 23 has two outer side faces 231 respectively on left and right sides, the two outer side faces 231 each are provided with the guide groove 101 recessed inwardly, that is, the two guide grooves 101 are respectively provided to the two outer side faces 231 of the insulating body 23. The main body 31 of the plug assembly 200 has two inner side faces 313 facing each other, and the two guide blocks 33 respectively protrudes from the two inner side faces 313 and respectively correspond to the two guide grooves 101. When the plug assembly 200 is mated with the receptacle assembly 100, the two guide blocks 33 respectively enter into the two guide grooves 101 along the mating direction D, such that the mating end portion 411 of the plug assembly 200 can enter into the slot 21 of the connector 2. Similarly, in the third embodiment, the plug assembly 200 cannot be inserted into the SFP receptacle generally having no corresponding guide groove, when the plug assembly 200 is to be inserted into the conventional SFP receptacle, the guide block 33 is stopped by a front edge of the connector of the SFP receptacle, such that the mating end portion 411 of the plug assembly 200 cannot be inserted into the slot of the connector of the SFP receptacle so as to achieve the function of preventing improper insertion. In a varied embodiment, it can also be implemented that only one of the outer side faces 231 of the insulating body 23 is provided with a guide groove 101, certainly, the guide block 33 is provided corresponding to the guide groove 101.

In conclusion, the plug assembly 200 can only be mated with the receptacle assembly 100 provided with the corresponding guide groove 101 by means of the guide block 33, which can prevent the plug assembly 200 from being improperly inserted into the receptacle assembly generally having no corresponding guide groove, so as to achieve the function of preventing improper insertion.

The above described contents are only the embodiments of the present disclosure, which cannot limit the scope of the implementation of the present disclosure, namely simple equivalent variations and modifications made according to the claims and the content of the present disclosure are still fallen within the scope of the present disclosure.

What is claimed is:

1. An electrical connection device, comprising:

a receptacle assembly comprising a cage and a connector, the cage comprises a grounding frame open to a port positioned at a front end and an accommodating space extending backwardly from the port along a mating direction, the connector being positioned in the accommodating space and having a slot, an entrance of the slot being aligned with the port and extending backwardly along the mating direction; and a plug assembly comprising an outer housing and a communication module provided in the outer housing, the outer housing having a main body which can be inserted into the cage along the mating direction to be mated with the connector, the communication module having a circuit board positioned in the main body, and the circuit board having a mating end portion used to be inserted into the slot;

wherein the receptacle assembly is provided with at least one guide groove extending along the mating direction, and the outer housing of the plug assembly is provided with at least one guide block protruding from the main body to correspond to the at least one guide groove, when the plug assembly is mated with the receptacle assembly, the at least one guide block enters into the corresponding guide groove along the mating direction, wherein the at least one guide groove is provided to the cage, and wherein the cage further comprises a shell, the shell has a top wall, two side walls respectively connected to two sides of the top wall, a rear wall connecting the top wall and the two side walls and facing the port, the top wall and the two side walls together define the port, and the at least one guide groove is formed in the top wall.

2. The electrical connection device of claim 1, wherein the at least one guide groove is an open groove extending backwardly from the port along the mating direction on the cage.

3. The electrical connection device of claim 1, wherein the cage has two guide grooves spaced apart from each other.

4. The electrical connection device of claim 1, wherein the cage further comprises a grounding frame, the grounding frame comprises an upper frame portion and a lower frame portion, the upper frame portion and the lower frame portion together surround a periphery of the shell adjacent to the port, and a portion of the upper frame portion overlapped with the top wall is formed with a guide portion used to guide the at least one guide block.

5. The electrical connection device of claim 1, wherein the cage comprises a shell, the shell has a top wall, two side walls respectively connected to two sides of the top wall, a rear wall connecting the top wall and the two side walls and facing the port and a bottom wall connected to the two side walls and facing the top wall, the bottom wall, the top wall and the two side walls together define the port, the main body of the plug assembly has a top face, the at least one guide block is a block protruding from the top face, the at least one guide groove extends backwardly from the port along the mating direction and is defined by an avoiding portion, the avoiding portion is formed to the top wall and defines the guide groove extending backwardly from the port along the mating direction to accommodate the guide block correspondingly.

6. The electrical connection device of claim 1, wherein the mating end portion of the circuit board is provided with totally four rows of conductive pads which are respectively arranged in front two rows and back two rows in the mating direction on opposite two board surfaces of the mating end portion, the connector further has a plurality of terminals arranged in four rows and each terminal has an elastic contact portion extending into the slot, the elastic contact portions of the plurality of terminals are arranged in front two rows and back two rows in the mating direction in the slot and the front two rows face each other in the up-down direction and the back two rows face each other in the up-down direction, so that the plurality of elastic contact portions respectively contact the plurality of conductive pads to form an electrical connection when the mating end portion is inserted into the slot.

7. The electrical connection device of claim 1, wherein at least one of the receptacle assembly and the plug assembly conform to a SFP-DD specification.

8. The electrical connection device of claim 1, wherein the at least one guide groove is provided to the connector.

9. The electrical connection device of claim 8, wherein the connector further has an insulating body, the insulating body defines the slot and has two outer side faces respectively on left and right sides, at least one of the two outer side faces is provided with the at least one guide groove recessed inwardly, the main body of the plug assembly has two inner side faces facing each other, and at least one of the two inner side faces is provided with the at least one guide block protruding therefrom.

10. A plug assembly configured to be mated with a receptacle assembly having at least one guide groove extending along a mating direction, the plug assembly comprising:

an outer housing having a main body configured to be mated with the receptacle assembly by insertion into the receptacle assembly along the mating direction and having at least one guide block protruding from the main body to correspond to the at least one guide groove, when the plug assembly is mated with the receptacle assembly, the at least one guide block entering into the corresponding guide groove along the mating direction; and a communication module provided in the outer housing and having a circuit board positioned in the main body, and the circuit board having a mating end portion, wherein the plug assembly conforms to a SFP-DD specification.

11. The plug assembly of claim 10, wherein the mating end portion of the circuit board is provided with totally four rows of conductive pads which are respectively arranged in front two rows and back two rows in the mating direction on opposite two board surfaces of the mating end portion.

12. The plug assembly of claim 10, wherein the main body of the plug assembly has a top face and the at least one guide block protrudes from the top face.

* * * * *